US008177215B2

(12) United States Patent
Ohkawa

(10) Patent No.: US 8,177,215 B2
(45) Date of Patent: May 15, 2012

(54) POST-PROCESSING APPARATUS

(75) Inventor: Yasunobu Ohkawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 577 days.

(21) Appl. No.: 12/397,432

(22) Filed: Mar. 4, 2009

(65) Prior Publication Data

US 2009/0226230 A1 Sep. 10, 2009

(30) Foreign Application Priority Data

Mar. 7, 2008 (JP) ..... 2008-058234

(51) Int. Cl.
*B65H 37/04* (2006.01)

(52) U.S. Cl. ..... 270/58.11; 270/58.07; 270/58.08; 270/58.09

(58) Field of Classification Search ..... 270/58.07, 270/58.08, 58.09, 58.11
See application file for complete search history.

(56) References Cited

U.S. PATENT DOCUMENTS

| | | | | |
|---|---|---|---|---|
| 6,296,247 | B1 * | 10/2001 | Tamura et al. | 271/214 |
| 6,494,449 | B2 * | 12/2002 | Tamura et al. | 271/214 |
| 2006/0120782 | A1 | 6/2006 | Nakamura et al. | |
| 2007/0176346 | A1 | 8/2007 | Ochi et al. | |

FOREIGN PATENT DOCUMENTS

| | | |
|---|---|---|
| JP | 3-63192 | 3/1991 |
| JP | 6-8666 | 1/1994 |
| JP | 2006-91423 | 4/2006 |
| JP | 2006-182561 | 7/2006 |
| JP | 2007-153543 A | 6/2007 |
| JP | 2007-197188 | 8/2007 |

OTHER PUBLICATIONS

U.S. Appl. No. 12/397,436, filed Mar. 4, 2009, entitled "Image Processing Apparatus".

* cited by examiner

*Primary Examiner* — Leslie A Nicholson, III
(74) *Attorney, Agent, or Firm* — Nixon & Vanderhye P.C.

(57) ABSTRACT

The present invention provides a post-processing apparatus that can handle recording sheets set to be stapled and recording sheets not set to be stapled in a single job and reliably prevent post-processed recording sheets from falling off a tray. The post-processing apparatus includes a post-processing section 5 that performs stapling processing based on an input condition and two trays 8*a* and 8*b* on which processed recording sheets are loaded. The input condition includes mixed-processing information about first processing that involves stapling processing and second processing that does not involve stapling processing. The control section 90 performs the first processing and second processing on the recording sheets in a single job based on the mixed-processing information. The control section 90 loads the recording sheets subjected to the first processing and recording sheets subjected to the second processing onto different trays 8*a* and 8*b*.

13 Claims, 36 Drawing Sheets

FIG. 11

STAPLING POSITION (CENTRAL 2 POINTS)

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 HORIZONTAL | 1～10 | 23 | 0 | 24 | 0 | 240 (10 SHEETS X 24 SETS) | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 280 | MAX(MIXTURE: STAPLED & NON-STAPLED) |
| A4 HORIZONTAL | 11～20 | 25 | 0 | 26 | 0 | 520 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 600 | MAX(MIXTURE: STAPLED & NON-STAPLED) |
| A4 HORIZONTAL | 21～30 | 27 | 0 | 28 | 0 | 840 | MAX(STAPLED ONLY) |
| | | 26 | 2 | 27 | 2 | | |
| | | 25 | 4 | 26 | 4 | | |
| | | 24 | 6 | 25 | 6 | | |
| | | 23 | 8 | 24 | 8 | 960 | MAX(MIXTURE: STAPLED & NON-STAPLED) |
| A4 HORIZONTAL | 31～40 | 29 | 0 | 30 | 0 | 1200 | MAX(STAPLED ONLY) |
| | | 28 | 2 | 29 | 2 | | |
| | | 27 | 4 | 28 | 4 | | |
| | | 26 | 6 | 28 | 6 | | |
| | | 25 | 8 | 26 | 8 | 1360 | MAX(MIXTURE: STAPLED & NON-STAPLED) |
| A4 HORIZONTAL | 41～50 | 31 | 0 | 32 | 0 | 1600 | MAX(STAPLED ONLY) |
| | | 30 | 2 | 31 | 2 | | |
| | | 29 | 4 | 30 | 4 | | |
| | | 28 | 6 | 29 | 6 | | |
| | | 27 | 8 | 28 | 8 | 1800 | MAX(MIXTURE: STAPLED & NON-STAPLED) |

FIG.12

STAPLING POSITION (CENTRAL 2 POINTS)

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 VERTICAL | 1～10 | 23 | 0 | 24 | 0 | 240 (10 SHEETS X 24 SETS) | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 280 | MAX(MIXTURE: STAPLED & NON-STAPLED) |
| A4 VERTICAL | 11～20 | 25 | 0 | 26 | 0 | 520 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 600 | MAX(MIXTURE: STAPLED & NON-STAPLED) |
| A4 VERTICAL | 21～30 | 27 | 0 | 28 | 0 | 840 | MAX(STAPLED ONLY) |
| | | 26 | 2 | 27 | 2 | | |
| | | 25 | 4 | 26 | 4 | | |
| | | 24 | 6 | 25 | 6 | | |
| | | 23 | 8 | 24 | 8 | 960 | MAX(MIXTURE: STAPLED & NON-STAPLED) |
| A4 VERTICAL | 31～40 | 29 | 0 | 30 | 0 | 1200 | MAX(STAPLED ONLY) |
| | | 28 | 2 | 29 | 2 | | |
| | | 27 | 4 | 28 | 4 | | |
| | | 26 | 6 | 28 | 6 | | |
| | | 25 | 8 | 26 | 8 | 1360 | MAX(MIXTURE: STAPLED & NON-STAPLED) |
| A4 VERTICAL | 41～50 | 31 | 0 | 32 | 0 | 1600 | MAX(STAPLED ONLY) |
| | | 30 | 2 | 31 | 2 | | |
| | | 29 | 4 | 30 | 4 | | |
| | | 28 | 6 | 29 | 6 | | |
| | | 27 | 8 | 28 | 8 | 1800 | MAX(MIXTURE: STAPLED & NON-STAPLED) |

FIG. 13

STAPLING POSITION (CENTRAL 2 POINTS)

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A3 VERTICAL | 1～10 | 23 | 0 | 24 | 0 | 240 (10 SHEETS X 24 SETS) | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 280 | MAX(MIXTURE: STAPLED & NON-STAPLED) |
| A3 VERTICAL | 11～20 | 25 | 0 | 26 | 0 | 520 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 600 | MAX(MIXTURE: STAPLED & NON-STAPLED) |
| A3 VERTICAL | 21～30 | 27 | 0 | 28 | 0 | 840 | MAX(STAPLED ONLY) |
| | | 26 | 2 | 27 | 2 | | |
| | | 25 | 4 | 26 | 4 | | |
| | | 24 | 6 | 25 | 6 | | |
| | | 23 | 8 | 24 | 8 | 960 | MAX(MIXTURE: STAPLED & NON-STAPLED) |
| A3 VERTICAL | 31～40 | 29 | 0 | 30 | 0 | 1200 | MAX(STAPLED ONLY) |
| | | 28 | 2 | 29 | 2 | | |
| | | 27 | 4 | 28 | 4 | | |
| | | 26 | 6 | 28 | 6 | | |
| | | 25 | 8 | 26 | 8 | 1360 | MAX(MIXTURE: STAPLED & NON-STAPLED) |
| A3 VERTICAL | 41～50 | 31 | 0 | 32 | 0 | 1600 | MAX(STAPLED ONLY) |
| | | 30 | 2 | 31 | 2 | | |
| | | 29 | 4 | 30 | 4 | | |
| | | 28 | 6 | 29 | 6 | | |
| | | 27 | 8 | 28 | 8 | 1800 | MAX(MIXTURE: STAPLED & NON-STAPLED) |

FIG. 14

STAPLING POSITION (CENTRAL 2 POINTS)

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| B5 HORIZONTAL | 1～10 | 26 | 0 | 27 | 0 | 270 (10 SHEETS X 27 SETS) | MAX(STAPLED ONLY) |
| | | 25 | 2 | 26 | 2 | | |
| | | 24 | 4 | 25 | 4 | | |
| | | 23 | 6 | 24 | 6 | | |
| | | 22 | 8 | 23 | 8 | 220 | MAX(MIXTURE: STAPLED & NON-STAPLED) |
| B5 HORIZONTAL | 11～20 | 27 | 0 | 28 | 0 | 560 | MAX(STAPLED ONLY) |
| | | 26 | 2 | 27 | 2 | | |
| | | 25 | 4 | 26 | 4 | | |
| | | 24 | 6 | 25 | 6 | | |
| | | 23 | 8 | 24 | 8 | 640 | MAX(MIXTURE: STAPLED & NON-STAPLED) |
| B5 HORIZONTAL | 21～30 | 29 | 0 | 30 | 0 | 900 | MAX(STAPLED ONLY) |
| | | 28 | 2 | 29 | 2 | | |
| | | 27 | 4 | 28 | 4 | | |
| | | 26 | 6 | 27 | 6 | | |
| | | 25 | 8 | 26 | 8 | 1020 | MAX(MIXTURE: STAPLED & NON-STAPLED) |
| B5 HORIZONTAL | 31～40 | 31 | 0 | 32 | 0 | 1280 | MAX(STAPLED ONLY) |
| | | 30 | 2 | 31 | 2 | | |
| | | 29 | 4 | 30 | 4 | | |
| | | 28 | 6 | 29 | 6 | | |
| | | 27 | 8 | 28 | 8 | 1440 | MAX(MIXTURE: STAPLED & NON-STAPLED) |
| B5 HORIZONTAL | 41～50 | 33 | 0 | 34 | 0 | 1700 | MAX(STAPLED ONLY) |
| | | 32 | 2 | 33 | 2 | | |
| | | 31 | 4 | 32 | 4 | | |
| | | 30 | 6 | 31 | 6 | | |
| | | 29 | 8 | 30 | 8 | 1900 | MAX(MIXTURE: STAPLED & NON-STAPLED) |

FIG. 15

STAPLING POSITION (BACK 1 POINT: PARALLEL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 HORIZONTAL | 1～10 | 21 | 0 | 22 | 0 | 220 (10 SHEETS X 22 SETS) | MAX(STAPLED ONLY) |
| | | 20 | 2 | 21 | 2 | | |
| | | 19 | 4 | 20 | 4 | | |
| | | 18 | 6 | 19 | 6 | | |
| | | 17 | 8 | 18 | 8 | 260 | MAX(MIXTURE: STAPLED & NON-STAPLED) |
| A4 HORIZONTAL | 11～20 | 23 | 0 | 24 | 0 | 480 | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 560 | MAX(MIXTURE: STAPLED & NON-STAPLED) |
| A4 HORIZONTAL | 21～30 | 25 | 0 | 26 | 0 | 780 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 900 | MAX(MIXTURE: STAPLED & NON-STAPLED) |
| A4 HORIZONTAL | 31～40 | 27 | 0 | 28 | 0 | 1120 | MAX(STAPLED ONLY) |
| | | 26 | 2 | 28 | 2 | | |
| | | 25 | 4 | 26 | 4 | | |
| | | 24 | 6 | 25 | 6 | | |
| | | 23 | 8 | 24 | 8 | 1280 | MAX(MIXTURE: STAPLED & NON-STAPLED) |
| A4 HORIZONTAL | 41～50 | 29 | 0 | 30 | 0 | 1500 | MAX(STAPLED ONLY) |
| | | 28 | 2 | 29 | 2 | | |
| | | 27 | 4 | 28 | 4 | | |
| | | 26 | 6 | 27 | 6 | | |
| | | 25 | 8 | 26 | 8 | 1750 | MAX(MIXTURE: STAPLED & NON-STAPLED) |

FIG. 16

STAPLING POSITION (BACK 1 POINT: PARALLEL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 VERTICAL | 1～10 | 21 | 0 | 22 | 0 | 220 (10 SHEETS X 22 SETS) | MAX(STAPLED ONLY) |
| | | 20 | 2 | 21 | 2 | | |
| | | 19 | 4 | 20 | 4 | | |
| | | 18 | 6 | 19 | 6 | | |
| | | 17 | 8 | 18 | 8 | 260 | MAX(MIXTURE: STAPLED & NON-STAPLED) |
| A4 VERTICAL | 11～20 | 23 | 0 | 24 | 0 | 480 | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 560 | MAX(MIXTURE: STAPLED & NON-STAPLED) |
| A4 VERTICAL | 21～30 | 25 | 0 | 26 | 0 | 780 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 900 | MAX(MIXTURE: STAPLED & NON-STAPLED) |
| A4 VERTICAL | 31～40 | 27 | 0 | 28 | 0 | 1120 | MAX(STAPLED ONLY) |
| | | 26 | 2 | 28 | 2 | | |
| | | 25 | 4 | 26 | 4 | | |
| | | 24 | 6 | 25 | 6 | | |
| | | 23 | 8 | 24 | 8 | 1280 | MAX(MIXTURE: STAPLED & NON STAPLED) |
| A4 VERTICAL | 41～50 | 29 | 0 | 30 | 0 | 1500 | MAX(STAPLED ONLY) |
| | | 28 | 2 | 29 | 2 | | |
| | | 27 | 4 | 28 | 4 | | |
| | | 26 | 6 | 27 | 6 | | |
| | | 25 | 8 | 26 | 8 | 1750 | MAX(MIXTURE: STAPLED & NON-STAPLED) |

FIG. 17

STAPLING POSITION (BACK 1 POINT: PARALLEL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A3 VERTICAL | 1～10 | 21 | 0 | 22 | 0 | 220 (10 SHEETS X 22 SETS) | MAX(STAPLED ONLY) |
| | | 20 | 2 | 21 | 2 | | |
| | | 19 | 4 | 20 | 4 | | |
| | | 18 | 6 | 19 | 6 | | |
| | | 17 | 8 | 18 | 8 | 260 | MAX(MIXTURE: STAPLED & NON-STAPLED) |
| A3 VERTICAL | 11～20 | 23 | 0 | 24 | 0 | 480 | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 560 | MAX(MIXTURE: STAPLED & NON-STAPLED) |
| A3 VERTICAL | 21～30 | 25 | 0 | 26 | 0 | 780 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 900 | MAX(MIXTURE: STAPLED & NON-STAPLED) |
| A3 VERTICAL | 31～40 | 27 | 0 | 28 | 0 | 1120 | MAX(STAPLED ONLY) |
| | | 26 | 2 | 28 | 2 | | |
| | | 25 | 4 | 26 | 4 | | |
| | | 24 | 6 | 25 | 6 | | |
| | | 23 | 8 | 24 | 8 | 1280 | MAX(MIXTURE: STAPLED & NON-STAPLED) |
| A3 VERTICAL | 41～50 | 29 | 0 | 30 | 0 | 1500 | MAX(STAPLED ONLY) |
| | | 28 | 2 | 29 | 2 | | |
| | | 27 | 4 | 28 | 4 | | |
| | | 26 | 6 | 27 | 6 | | |
| | | 25 | 8 | 26 | 8 | 1750 | MAX(MIXTURE: STAPLED & NON-STAPLED) |

FIG. 18

STAPLING POSITION (BACK 1 POINT: PARALLEL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| B5 HORIZONTAL | 1～10 | 23 | 0 | 24 | 0 | 220 (10 SHEETS X 22 SETS) | MAX(STAPLED ONLY) |
| | | 22 | 2 | 23 | 2 | | |
| | | 21 | 4 | 22 | 4 | | |
| | | 20 | 6 | 21 | 6 | | |
| | | 19 | 8 | 20 | 8 | 280 | MAX(MIXTURE: STAPLED & NON-STAPLED) |
| B5 HORIZONTAL | 11～20 | 25 | 0 | 26 | 0 | 520 | MAX(STAPLED ONLY) |
| | | 24 | 2 | 25 | 2 | | |
| | | 23 | 4 | 24 | 4 | | |
| | | 22 | 6 | 23 | 6 | | |
| | | 21 | 8 | 22 | 8 | 600 | MAX(MIXTURE: STAPLED & NON-STAPLED) |
| B5 HORIZONTAL | 21～30 | 27 | 0 | 28 | 0 | 840 | MAX(STAPLED ONLY) |
| | | 26 | 2 | 27 | 2 | | |
| | | 25 | 4 | 26 | 4 | | |
| | | 24 | 6 | 25 | 6 | | |
| | | 23 | 8 | 24 | 8 | 960 | MAX(MIXTURE: STAPLED & NON-STAPLED) |
| B5 HORIZONTAL | 31～40 | 29 | 0 | 30 | 0 | 1200 | MAX(STAPLED ONLY) |
| | | 28 | 2 | 29 | 2 | | |
| | | 27 | 4 | 28 | 4 | | |
| | | 26 | 6 | 28 | 6 | | |
| | | 25 | 8 | 26 | 8 | 1360 | MAX(MIXTURE: STAPLED & NON-STAPLED) |
| B5 HORIZONTAL | 41～50 | 31 | 0 | 32 | 0 | 1600 | MAX(STAPLED ONLY) |
| | | 30 | 2 | 31 | 2 | | |
| | | 29 | 4 | 30 | 4 | | |
| | | 28 | 6 | 29 | 6 | | |
| | | 27 | 8 | 28 | 8 | 1800 | MAX(MIXTURE: STAPLED & NON-STAPLED) |

FIG. 19

STAPLING POSITION (FRONT 1 POINT: PARALLE

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 HORIZONTAL | 1～10 | 20 | 0 | 21 | 0 | 210 (10 SHEETS X 21 SETS) | MAX(STAPLED ONLY) |
| | | 19 | 2 | 20 | 2 | | |
| | | 18 | 4 | 19 | 4 | | |
| | | 17 | 6 | 18 | 6 | | |
| | | 16 | 8 | 17 | 8 | 250 | MAX(MIXTURE: STAPLED & NON-STAPLED) |
| A4 HORIZONTAL | 11～20 | 22 | 0 | 23 | 0 | 460 | MAX(STAPLED ONLY) |
| | | 21 | 2 | 22 | 2 | | |
| | | 20 | 4 | 21 | 4 | | |
| | | 19 | 6 | 20 | 6 | | |
| | | 18 | 8 | 19 | 8 | 540 | MAX(MIXTURE: STAPLED & NON-STAPLED) |
| A4 HORIZONTAL | 21～30 | 24 | 0 | 25 | 0 | 750 | MAX(STAPLED ONLY) |
| | | 23 | 2 | 24 | 2 | | |
| | | 22 | 4 | 23 | 4 | | |
| | | 21 | 6 | 22 | 6 | | |
| | | 20 | 8 | 21 | 8 | 870 | MAX(MIXTURE: STAPLED & NON-STAPLED) |
| A4 HORIZONTAL | 31～40 | 26 | 0 | 27 | 0 | 1080 | MAX(STAPLED ONLY) |
| | | 25 | 2 | 26 | 2 | | |
| | | 24 | 4 | 25 | 4 | | |
| | | 23 | 6 | 24 | 6 | | |
| | | 22 | 8 | 23 | 8 | 1240 | MAX(MIXTURE: STAPLED & NON-STAPLED) |
| A4 HORIZONTAL | 41～50 | 28 | 0 | 29 | 0 | 1450 | MAX(STAPLED ONLY) |
| | | 27 | 2 | 28 | 2 | | |
| | | 26 | 4 | 27 | 4 | | |
| | | 25 | 6 | 26 | 6 | | |
| | | 24 | 8 | 25 | 8 | 1650 | MAX(MIXTURE: STAPLED & NON-STAPLED) |

FIG. 20

STAPLING POSITION (FRONT 1 POINT: PARALLE

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 VERTICAL | 1～10 | 20 | 0 | 21 | 0 | 210 (10 SHEETS X 21 SETS) | MAX(STAPLED ONLY) |
| | | 19 | 2 | 20 | 2 | | |
| | | 18 | 4 | 19 | 4 | | |
| | | 17 | 6 | 18 | 6 | | |
| | | 16 | 8 | 17 | 8 | 250 | MAX(MIXTURE: STAPLED & NON-STAPLED) |
| A4 VERTICAL | 11～20 | 22 | 0 | 23 | 0 | 460 | MAX(STAPLED ONLY) |
| | | 21 | 2 | 22 | 2 | | |
| | | 20 | 4 | 21 | 4 | | |
| | | 19 | 6 | 20 | 6 | | |
| | | 18 | 8 | 19 | 8 | 540 | MAX(MIXTURE: STAPLED & NON-STAPLED) |
| A4 VERTICAL | 21～30 | 24 | 0 | 25 | 0 | 750 | MAX(STAPLED ONLY) |
| | | 23 | 2 | 24 | 2 | | |
| | | 22 | 4 | 23 | 4 | | |
| | | 21 | 6 | 22 | 6 | | |
| | | 20 | 8 | 21 | 8 | 870 | MAX(MIXTURE: STAPLED & NON-STAPLED) |
| A4 VERTICAL | 31～40 | 26 | 0 | 27 | 0 | 1080 | MAX(STAPLED ONLY) |
| | | 25 | 2 | 26 | 2 | | |
| | | 24 | 4 | 25 | 4 | | |
| | | 23 | 6 | 24 | 6 | | |
| | | 22 | 8 | 23 | 8 | 1240 | MAX(MIXTURE: STAPLED & NON-STAPLED) |
| A4 VERTICAL | 41～50 | 28 | 0 | 29 | 0 | 1450 | MAX(STAPLED ONLY) |
| | | 27 | 2 | 28 | 2 | | |
| | | 26 | 4 | 27 | 4 | | |
| | | 25 | 6 | 26 | 6 | | |
| | | 24 | 8 | 25 | 8 | 1650 | MAX(MIXTURE: STAPLED & NON-STAPLED) |

FIG. 21

STAPLING POSITION (FRONT 1 POINT: PARALLE

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A3 VERTICAL | 1～10 | 20 | 0 | 21 | 0 | 210 (10 SHEETS X 21 SETS) | MAX(STAPLED ONLY) |
| | | 19 | 2 | 20 | 2 | | |
| | | 18 | 4 | 19 | 4 | | |
| | | 17 | 6 | 18 | 6 | | |
| | | 16 | 8 | 17 | 8 | 250 | MAX(MIXTURE: STAPLED & NON-STAPLED) |
| A3 VERTICAL | 11～20 | 22 | 0 | 23 | 0 | 460 | MAX(STAPLED ONLY) |
| | | 21 | 2 | 22 | 2 | | |
| | | 20 | 4 | 21 | 4 | | |
| | | 19 | 6 | 20 | 6 | | |
| | | 18 | 8 | 19 | 8 | 540 | MAX(MIXTURE: STAPLED & NON-STAPLED) |
| A3 VERTICAL | 21～30 | 24 | 0 | 25 | 0 | 750 | MAX(STAPLED ONLY) |
| | | 23 | 2 | 24 | 2 | | |
| | | 22 | 4 | 23 | 4 | | |
| | | 21 | 6 | 22 | 6 | | |
| | | 20 | 8 | 21 | 8 | 870 | MAX(MIXTURE: STAPLED & NON-STAPLED) |
| A3 VERTICAL | 31～40 | 26 | 0 | 27 | 0 | 1080 | MAX(STAPLED ONLY) |
| | | 25 | 2 | 26 | 2 | | |
| | | 24 | 4 | 25 | 4 | | |
| | | 23 | 6 | 24 | 6 | | |
| | | 22 | 8 | 23 | 8 | 1240 | MAX(MIXTURE: STAPLED & NON-STAPLED) |
| A3 VERTICAL | 41～50 | 28 | 0 | 29 | 0 | 1450 | MAX(STAPLED ONLY) |
| | | 27 | 2 | 28 | 2 | | |
| | | 26 | 4 | 27 | 4 | | |
| | | 25 | 6 | 26 | 6 | | |
| | | 24 | 8 | 25 | 8 | 1650 | MAX(MIXTURE: STAPLED & NON-STAPLED) |

FIG. 22

STAPLING POSITION (FRONT 1 POINT: PARALLE

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| B5 HORIZONTAL | 1～10 | 22 | 0 | 23 | 0 | 230 (10 SHEETS X 23 SETS) | MAX(STAPLED ONLY) |
| | | 21 | 2 | 22 | 2 | | |
| | | 20 | 4 | 21 | 4 | | |
| | | 19 | 6 | 20 | 6 | | |
| | | 18 | 8 | 19 | 8 | 270 | MAX(MIXTURE: STAPLED & NON-STAPLED) |
| B5 HORIZONTAL | 11～20 | 24 | 0 | 25 | 0 | 500 | MAX(STAPLED ONLY) |
| | | 23 | 2 | 24 | 2 | | |
| | | 22 | 4 | 23 | 4 | | |
| | | 21 | 6 | 22 | 6 | | |
| | | 20 | 8 | 21 | 8 | 580 | MAX(MIXTURE: STAPLED & NON-STAPLED) |
| B5 HORIZONTAL | 21～30 | 26 | 0 | 27 | 0 | 810 | MAX(STAPLED ONLY) |
| | | 25 | 2 | 26 | 2 | | |
| | | 24 | 4 | 25 | 4 | | |
| | | 23 | 6 | 24 | 6 | | |
| | | 22 | 8 | 23 | 8 | 930 | MAX(MIXTURE: STAPLED & NON-STAPLED) |
| B5 HORIZONTAL | 31～40 | 28 | 0 | 29 | 0 | 1160 | MAX(STAPLED ONLY) |
| | | 27 | 2 | 28 | 2 | | |
| | | 26 | 4 | 27 | 4 | | |
| | | 25 | 6 | 26 | 6 | | |
| | | 24 | 8 | 25 | 8 | 1320 | MAX(MIXTURE: STAPLED & NON-STAPLED) |
| B5 HORIZONTAL | 41～50 | 30 | 0 | 31 | 0 | 1550 | MAX(STAPLED ONLY) |
| | | 29 | 2 | 30 | 2 | | |
| | | 28 | 4 | 29 | 4 | | |
| | | 27 | 6 | 28 | 6 | | |
| | | 26 | 8 | 27 | 8 | 1750 | MAX(MIXTURE: STAPLED & NON-STAPLED) |

FIG. 23

STAPLING POSITION (BACK 1 POINT: DIAGONAL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 HORIZONTAL | 1～10 | 14 | 0 | 16 | 0 | 160 (10 SHEETS X 16 SETS) | MAX(STAPLED ONLY) |
| | | 13 | 2 | 15 | 2 | | |
| | | 12 | 4 | 14 | 4 | | |
| | | 11 | 6 | 13 | 6 | | |
| | | 10 | 8 | 12 | 8 | 200 | MAX(MIXTURE: STAPLED & NON-STAPLED) |
| A4 HORIZONTAL | 11～20 | 16 | 0 | 18 | 0 | 360 | MAX(STAPLED ONLY) |
| | | 15 | 2 | 17 | 2 | | |
| | | 14 | 4 | 16 | 4 | | |
| | | 13 | 6 | 15 | 6 | | |
| | | 12 | 8 | 14 | 8 | 440 | MAX(MIXTURE: STAPLED & NON-STAPLED) |
| A4 HORIZONTAL | 21～30 | 18 | 0 | 20 | 0 | 600 | MAX(STAPLED ONLY) |
| | | 17 | 2 | 19 | 2 | | |
| | | 18 | 4 | 18 | 4 | | |
| | | 19 | 6 | 17 | 6 | | |
| | | 20 | 8 | 16 | 8 | 720 | MAX(MIXTURE: STAPLED & NON-STAPLED) |
| A4 HORIZONTAL | 31～40 | 20 | 0 | 22 | 0 | 880 | MAX(STAPLED ONLY) |
| | | 19 | 2 | 21 | 2 | | |
| | | 18 | 4 | 20 | 4 | | |
| | | 17 | 6 | 19 | 6 | | |
| | | 16 | 8 | 18 | 8 | 1040 | MAX(MIXTURE: STAPLED & NON-STAPLED) |
| A4 HORIZONTAL | 41～50 | 22 | 0 | 24 | 0 | 1200 | MAX(STAPLED ONLY) |
| | | 21 | 2 | 23 | 2 | | |
| | | 20 | 4 | 22 | 4 | | |
| | | 18 | 6 | 21 | 6 | | |
| | | 19 | 8 | 20 | 8 | 1400 | MAX(MIXTURE: STAPLED & NON-STAPLED) |

FIG. 24

STAPLING POSITION (BACK 1 POINT: DIAGONAL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A4 VERTICAL | 1～10 | 14 | 0 | 16 | 0 | 160 (10 SHEETS X 16 SETS) | MAX(STAPLED ONLY) |
| | | 13 | 2 | 15 | 2 | | |
| | | 12 | 4 | 14 | 4 | | |
| | | 11 | 6 | 13 | 6 | | |
| | | 10 | 8 | 12 | 8 | 200 | MAX(MIXTURE: STAPLED & NON-STAPLED) |
| A4 VERTICAL | 11～20 | 16 | 0 | 18 | 0 | 360 | MAX(STAPLED ONLY) |
| | | 15 | 2 | 17 | 2 | | |
| | | 14 | 4 | 16 | 4 | | |
| | | 13 | 6 | 15 | 6 | | |
| | | 12 | 8 | 14 | 8 | 440 | MAX(MIXTURE: STAPLED & NON-STAPLED) |
| A4 VERTICAL | 21～30 | 18 | 0 | 20 | 0 | 600 | MAX(STAPLED ONLY) |
| | | 17 | 2 | 19 | 2 | | |
| | | 18 | 4 | 18 | 4 | | |
| | | 19 | 6 | 17 | 6 | | |
| | | 20 | 8 | 16 | 8 | 720 | MAX(MIXTURE: STAPLED & NON-STAPLED) |
| A4 VERTICAL | 31～40 | 20 | 0 | 22 | 0 | 880 | MAX(STAPLED ONLY) |
| | | 19 | 2 | 21 | 2 | | |
| | | 18 | 4 | 20 | 4 | | |
| | | 17 | 6 | 19 | 6 | | |
| | | 16 | 8 | 18 | 8 | 1040 | MAX(MIXTURE: STAPLED & NON-STAPLED) |
| A4 VERTICAL | 41～50 | 22 | 0 | 24 | 0 | 1200 | MAX(STAPLED ONLY) |
| | | 21 | 2 | 23 | 2 | | |
| | | 20 | 4 | 22 | 4 | | |
| | | 18 | 6 | 21 | 6 | | |
| | | 19 | 8 | 20 | 8 | 1400 | MAX(MIXTURE: STAPLED & NON-STAPLED) |

FIG. 25

STAPLING POSITION (BACK 1 POINT: DIAGONAL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| A3 VERTICAL | 1～10 | 14 | 0 | 16 | 0 | 160 (10 SHEETS X 16 SETS) | MAX(STAPLED ONLY) |
| | | 13 | 2 | 15 | 2 | | |
| | | 12 | 4 | 14 | 4 | | |
| | | 11 | 6 | 13 | 6 | | |
| | | 10 | 8 | 12 | 8 | 200 | MAX(MIXTURE: STAPLED & NON-STAPLED) |
| A3 VERTICAL | 11～20 | 16 | 0 | 18 | 0 | 360 | MAX(STAPLED ONLY) |
| | | 15 | 2 | 17 | 2 | | |
| | | 14 | 4 | 16 | 4 | | |
| | | 13 | 6 | 15 | 6 | | |
| | | 12 | 8 | 14 | 8 | 440 | MAX(MIXTURE: STAPLED & NON-STAPLED) |
| A3 VERTICAL | 21～30 | 18 | 0 | 20 | 0 | 600 | MAX(STAPLED ONLY) |
| | | 17 | 2 | 19 | 2 | | |
| | | 18 | 4 | 18 | 4 | | |
| | | 19 | 6 | 17 | 6 | | |
| | | 20 | 8 | 16 | 8 | 720 | MAX(MIXTURE: STAPLED & NON-STAPLED) |
| A3 VERTICAL | 31～40 | 20 | 0 | 22 | 0 | 880 | MAX(STAPLED ONLY) |
| | | 19 | 2 | 21 | 2 | | |
| | | 18 | 4 | 20 | 4 | | |
| | | 17 | 6 | 19 | 6 | | |
| | | 16 | 8 | 18 | 8 | 1040 | MAX(MIXTURE: STAPLED & NON-STAPLED) |
| A3 VERTICAL | 41～50 | 22 | 0 | 24 | 0 | 1200 | MAX(STAPLED ONLY) |
| | | 21 | 2 | 23 | 2 | | |
| | | 20 | 4 | 22 | 4 | | |
| | | 18 | 6 | 21 | 6 | | |
| | | 19 | 8 | 20 | 8 | 1400 | MAX(MIXTURE: STAPLED & NON-STAPLED) |

FIG. 26

STAPLING POSITION (BACK 1 POINT: DIAGONAL

| SHEET(SHEET FOR PASSING) SIZE | SHEETS PER BUNDLE | BASIS WEIGHT BELOW 200 g/m² | | BASIS WEIGHT 200 g/m² OR ABOVE | | EJECTION-TRAY CAPACITY (SHEETS) | |
|---|---|---|---|---|---|---|---|
| | | STAPLED | NON-STAPLED | STAPLED | NON-STAPLED | | |
| B5 HORIZONTAL | 1～10 | 16 | 0 | 18 | 0 | 180 (10 SHEETS X 18 SETS) | MAX(STAPLED ONLY) |
| | | 15 | 2 | 17 | 2 | | |
| | | 14 | 4 | 16 | 4 | | |
| | | 13 | 6 | 15 | 6 | | |
| | | 11 | 8 | 14 | 8 | 220 | MAX(MIXTURE: STAPLED & NON-STAPLED) |
| B5 HORIZONTAL | 11～20 | 18 | 0 | 20 | 0 | 400 | MAX(STAPLED ONLY) |
| | | 17 | 2 | 19 | 2 | | |
| | | 18 | 4 | 18 | 4 | | |
| | | 19 | 6 | 17 | 6 | | |
| | | 20 | 8 | 16 | 8 | 480 | MAX(MIXTURE: STAPLED & NON-STAPLED) |
| B5 HORIZONTAL | 21～30 | 20 | 0 | 22 | 0 | 660 | MAX(STAPLED ONLY) |
| | | 19 | 2 | 21 | 2 | | |
| | | 18 | 4 | 20 | 4 | | |
| | | 17 | 6 | 19 | 6 | | |
| | | 16 | 8 | 18 | 8 | 780 | MAX(MIXTURE: STAPLED & NON-STAPLED) |
| B5 HORIZONTAL | 31～40 | 22 | 0 | 24 | 0 | 960 | MAX(STAPLED ONLY) |
| | | 21 | 2 | 23 | 2 | | |
| | | 20 | 4 | 22 | 4 | | |
| | | 18 | 6 | 21 | 6 | | |
| | | 19 | 8 | 20 | 8 | 1120 | MAX(MIXTURE: STAPLED & NON-STAPLED) |
| B5 HORIZONTAL | 41～50 | 24 | 0 | 26 | 0 | 1300 | MAX(STAPLED ONLY) |
| | | 23 | 2 | 25 | 2 | | |
| | | 22 | 4 | 24 | 4 | | |
| | | 21 | 6 | 23 | 6 | | |
| | | 20 | 8 | 22 | 8 | 1500 | MAX(MIXTURE: STAPLED & NON-STAPLED) |

FIG. 28

CHECK A DESIRED ITEM AND PRESS THE START KEY

| STAPLE | BACK 1 POINT (DIAGONAL) | | | |
|---|---|---|---|---|

| | | | |
|---|---|---|---|
| SHEETS SUBJECTED TO FIRST PROCESSING | 16 SETS | TOTAL | 16 SETS |
| SHEETS SUBJECTED TO SECOND PROCESSING | 0 SET | | |
| SHEETS SUBJECTED TO FIRST PROCESSING | 15 SETS | TOTAL | 17 SETS |
| SHEETS SUBJECTED TO SECOND PROCESSING | 2 SETS | | |
| SHEETS SUBJECTED TO FIRST PROCESSING | 14 SETS | TOTAL | 18 SETS |
| SHEETS SUBJECTED TO SECOND PROCESSING | 4 SETS | | |
| SHEETS SUBJECTED TO FIRST PROCESSING | 13 SETS | TOTAL | 19 SETS |
| SHEETS SUBJECTED TO SECOND PROCESSING | 6 SETS | | |
| SHEETS SUBJECTED TO FIRST PROCESSING | 12 SETS | TOTAL | 20 SETS |
| SHEETS SUBJECTED TO SECOND PROCESSING | 8 SETS | | |

FIG. 36
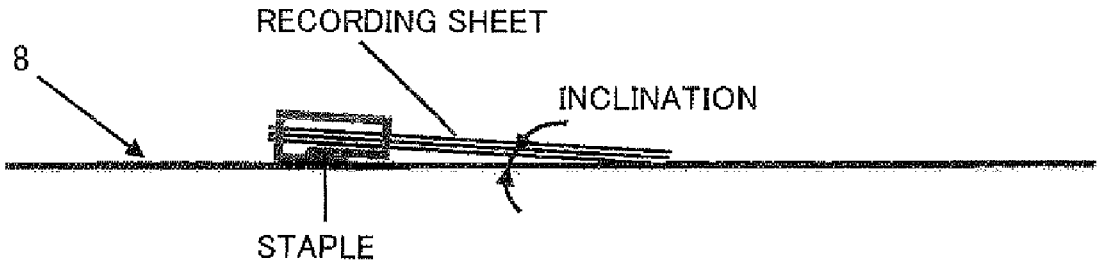
(a)
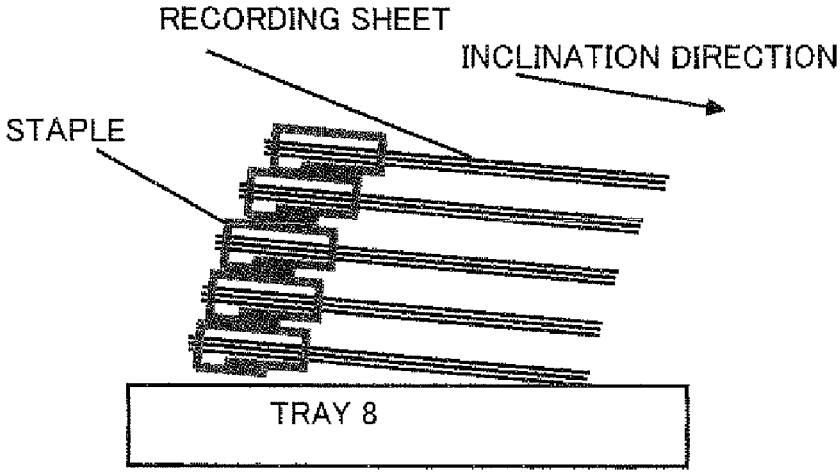
(b)

FIG. 37

SPECIFY THE NUMBERS OF SETS OF SHEETS TO BE STAPLED
AND NOT TO BE STAPLED

| | | |
|---|---|---|
| SHEETS TO BE STAPLED | 16 | SETS |
| SHEETS TO TO EB STAPLED | 0 | SETS |
| | TOTAL | 16 SETS |

POST-PROCESSING APPARATUS

BACKGROUND OF THE TECHNOLOGY

1. Field of the Technology

The present technology relates to a post-processing apparatus that performs post-processing on recording sheets.

2. Description of the Related Art

The development of post-processing apparatuses that perform post-processing on recording sheets subjected to processing such as image formation has been underway in recent years. Such a post-processing apparatus has post-processing functions such as stapling, punching and bookbinding functions.

Post-processed recording sheets are loaded into a tray provided downstream of the post-processing apparatus. However, there is a problem in that depending on input conditions (the number of sheets bound, the number of staples, stapling positions, the number of sheets ejected or the like), a desired number of post-processed recording sheets cannot be loaded onto the tray, which may case any excessive recording sheets to fall off the tray.

Japanese Patent Laid-Open No. 06-008666, Japanese Patent Laid-Open No. 03-063192 and Japanese Patent Laid-Open No. 2007-197188 disclose post-processing apparatuses which can prevent post-processed recording sheets from falling off a tray.

The invention disclosed in Japanese Patent Laid-Open No. 06-008666 can change a stapling position for each ejected bundle of recording sheets, thereby avoid overlaps in the stapling position among bundles and reduce the bulk of the bundles.

The invention disclosed in Japanese Patent Laid-Open No. 03-063192 is configured such that when the number of recording sheets in a bundle exceeds an upper limit of stapling processing, the recording sheets can be stapled within the upper limit with the remaining recording sheets left non-stapled.

The invention disclosed in Japanese Patent Laid-Open No. 2007-197188 is configured such that when an upper limit of stapling processing is exceeded, stapling processing can be cancelled.

However, the invention disclosed in Japanese Patent Laid-Open No. 06-008666 changes a stapling position for each bundle of recording sheets automatically, to prevent the bundles of recording sheets from falling off the tray. This causes a problem in that the bundles are not stapled at positions desired by a user.

With the inventions disclosed in Japanese Patent Laid-Open No. 03-063192 and Japanese Patent Laid-Open No. 2007-197188, when the upper limit of stapling processing is exceeded, stapling processing of the remaining recording sheets is cancelled automatically. This causes a problem in that processing is not performed as the user wishes.

On the other hand, the user has a desire to handle recording sheets set to be stapled and recording sheets not set to be stapled in a single job, i.e., in a single processing run. The inventions disclosed in Japanese Patent Laid-Open No. 06-008666, Japanese Patent Laid-Open No. 03-063192 and Japanese Patent Laid-Open No. 2007-197188 cannot satisfy such a desire.

It is an object of the present technology to provide a post-processing apparatus that can handle recording sheets set to be stapled and recording sheets not set to be stapled in a single job and reliably prevent post-processed recording sheets from falling off a tray.

SUMMARY OF THE TECHNOLOGY

In order to attain the above-described object, the present technology includes a post-processing section that performs stapling processing, a control section that controls the post-processing section based on an input condition, and a tray on which post-processed recording sheets are loaded, wherein the input condition includes mixed-processing information about first processing that involves stapling processing and second processing that does not involve stapling processing, the control section makes the post-processing section load recording sheets subjected to the first processing and recording sheets subjected to the second processing as a mixture thereof onto the tray in a single job.

A post-processing apparatus according to the present technology creates recording sheets set to be stapled and recording sheets not set to be stapled in a single job, i.e., in a single processing run. Recording sheets of each of the two types are either stapled or not stapled based on the mixed-processing information included in the input condition.

The input condition includes stapling conditions that provide stapling information needed to perform stapling processing using the post-processing apparatus.

The stapling conditions include information on the positions of staples with respect to recording sheets, information on the orientation of staples with respect to the recording sheets, information on the number of recording sheets bound per set and mixed-processing information on first processing that involves stapling processing and second processing that does not involve stapling processing.

Based on the mixed-processing information included in the input condition, the post-processing section performs the first processing that involves stapling processing and the second processing that does not involve stapling processing. The mixed-processing information may describe only one of the first processing and second processing.

When an image formation apparatus that forms images on recording sheets is provided, the input condition may include printing conditions that provide printing information needed to form images on recording sheets using the image formation apparatus.

The printing conditions include information about the size, orientation and basis weight of recording sheets and the number of recording sheets on which images are formed, in addition to the conditions related to types of printing such as single-side printing that involves forming an image only on one side of each recording sheet, double-side printing that involves forming images on both sides of each recording sheet and N-up printing that involves printing N pages on one side of each recording sheet.

The post-processing apparatus that staples recording sheets is controlled by the control section. The control section loads the stapled recording sheets onto a tray provided downstream of the post-processing apparatus. When the first processing and second processing are performed, the control section can load bound recording sheets and non-bound recording sheets together in a single tray. If the post-processing apparatus is provided with multiple trays, the control section can load the recording sheets subjected to the first processing and the recording sheets subjected to the second processing onto different trays. When loading the recording sheets subjected to the first processing and the recording sheets subjected to the second processing onto a single tray, the control section may load the recording sheets by offsetting the two types of recording sheets from each other.

According to geometry such as size and height of the tray, the tray has a maximum load capacity established in terms of the recording sheets that can be loaded. The maximum load capacity is established based on various input conditions including stapling conditions such as the positions of staples with respect to the tray, the number of recording sheets bound into a bundle, the number of recording sheets to be subjected to the first processing and the number of recording sheets to be subjected to the second processing.

The control section calculates a load of the recording sheets loaded onto the tray based on the input condition. The control section judges whether or not the calculated load exceeds the maximum load capacity of the tray. When the load exceeds the maximum load capacity, the control section changes a mixing ratio between recording sheets to be subjected to the first processing and recording sheets to be subjected to the second processing. That is, the control section changes the ratio between the number of recording sheets to be subjected to the first processing and the number of recording sheets to be subjected to the second processing.

When changing the mixing ratio of the recording sheets included in the input condition, the control section creates multiple input conditions that differ in mixed-processing information in order to load more recording sheets on to a tray. For example, based on the mixed-processing information, the control section decreases the proportion (number) of recording sheets to be subjected to the first processing and increases the proportion (number) of recording sheets to be subjected to the second processing.

The control section informs the user by presenting a list of input conditions that include changed mixed-processing information. As a means of informing the user, for example, the post-processing apparatus includes a display section that displays the input conditions. The control section also controls what is displayed by the display section. The control section makes the display section present a list of changed input conditions to the user. Alternatively, if the post-processing apparatus is capable of communicating with an outside terminal, the control section transmits the list of changed input conditions to the outside terminal from which the original input condition has been received.

The display section or outside terminal allows the user to select a desired input condition from the presented list using a touch key or keyboard. Information about the selected input condition is inputted in the control section of the post-processing apparatus from the display section or outside terminal.

The control section controls the post-processing in the post-processing apparatus based on the changed input condition. Then, based on the changed input condition, the post-processing apparatus produces a larger quantity of recording sheets and loads recording sheets commensurate in the number of sheets with the maximum load capacity onto the tray.

As described above, since two types of post-processed recording sheets—recording sheets subjected to the first processing and recording sheets subjected to the second processing—are created in a single job, the present technology can improve operating efficiency and reduce operating time compared with when the different types of recording sheets are produced individually in separate jobs. Also, since the control section loads the recording sheets subjected to the first processing and recording sheets subjected to the second processing onto different trays or loads the different types of recording sheets by offsetting the different types from each other, a sorting operation of the recording sheets becomes easier.

Furthermore, the control section determines whether the post-processed recording sheets can be loaded onto the tray, based on the input condition. If the load of the processed recording sheets exceeds the maximum load capacity, the control section presents new input conditions, prompting the user to make a selection from them. As the user selects a desired input condition from the presented list, optimum types of recording sheet desired by the user can be loaded in larger quantities onto the tray, making it possible to reduce the frequency with which the recording sheets are taken out of the tray. This in turn makes it possible to improve the operating efficiency and reliably prevent recording sheets from falling off the tray.

BRIEF DESCRIPTION OF THE DRAWINGS

FIG. 11 is a diagram showing a management table with stapling positions set to central 2 points on A4 size horizontal recording sheets;

FIG. 12 is a diagram showing a management table with stapling positions set to central 2 points on A4 size vertical recording sheets;

FIG. 13 is a diagram showing a management table with stapling positions set to central 2 points on A3 size vertical recording sheets;

FIG. 14 is a diagram showing a management table with stapling positions set to central 2 points on B5 size horizontal recording sheets;

FIG. 15 is a diagram showing a management table with a stapling position set to back 1 point (parallel) on A4 size horizontal recording sheets;

FIG. 16 is a diagram showing a management table with a stapling position set to back 1 point (parallel) on A4 size vertical recording sheets;

FIG. 17 is a diagram showing a management table with a stapling position set to back 1 point (parallel) on A3 size vertical recording sheets;

FIG. 18 is a diagram showing a management table with a stapling position set to back 1 point (parallel) on B5 size horizontal recording sheets;

FIG. 19 is a diagram showing a management table with a stapling position set to front 1 point (parallel) on A4 size horizontal recording sheets;

FIG. 20 is a diagram showing a management table with a stapling position set to front 1 point (parallel) on A4 size vertical recording sheets;

FIG. 21 is a diagram showing a management table with a stapling position set to front 1 point (parallel) on A3 size vertical recording sheets;

FIG. 22 is a diagram showing a management table with a stapling position set to front 1 point (parallel) on B5 size horizontal recording sheets;

FIG. 23 is a diagram showing a management table with a stapling position set to back 1 point (diagonal) on A4 size horizontal recording sheets;

FIG. 24 is a diagram showing a management table with a stapling position set to back 1 point (diagonal) on A4 size vertical recording sheets;

FIG. 25 is a diagram showing a management table with a stapling position set to back 1 point (diagonal) on A3 size vertical recording sheets;

FIG. 26 is a diagram showing a management table with a stapling position set to back 1 point (diagonal) on B5 size horizontal recording sheets;

FIG. 28 is a detailed view of the screen on the operation panel showing an example in which a message is displayed in the display section of the operation panel;

FIG. 36 is a diagram showing a relationship between staples and a maximum load capacity when recording sheets are loaded on a tray; and FIG. 37 is a detailed view of the screen on the operation panel showing an example in which an input mode for use to input the number of required sets is displayed in the display section of an operation section.

DETAILED DESCRIPTION OF THE PREFERRED EMBODIMENTS

Hereinafter, a post-processing apparatus according to the present technology will be explained in detail. For convenience of explanation, it is assumed that the post-processing apparatus is a multi-function peripheral, or an image processing apparatus 1, provided with a copy mode, printer mode, scanner mode, facsimile mode and filing mode.

Figure 1:
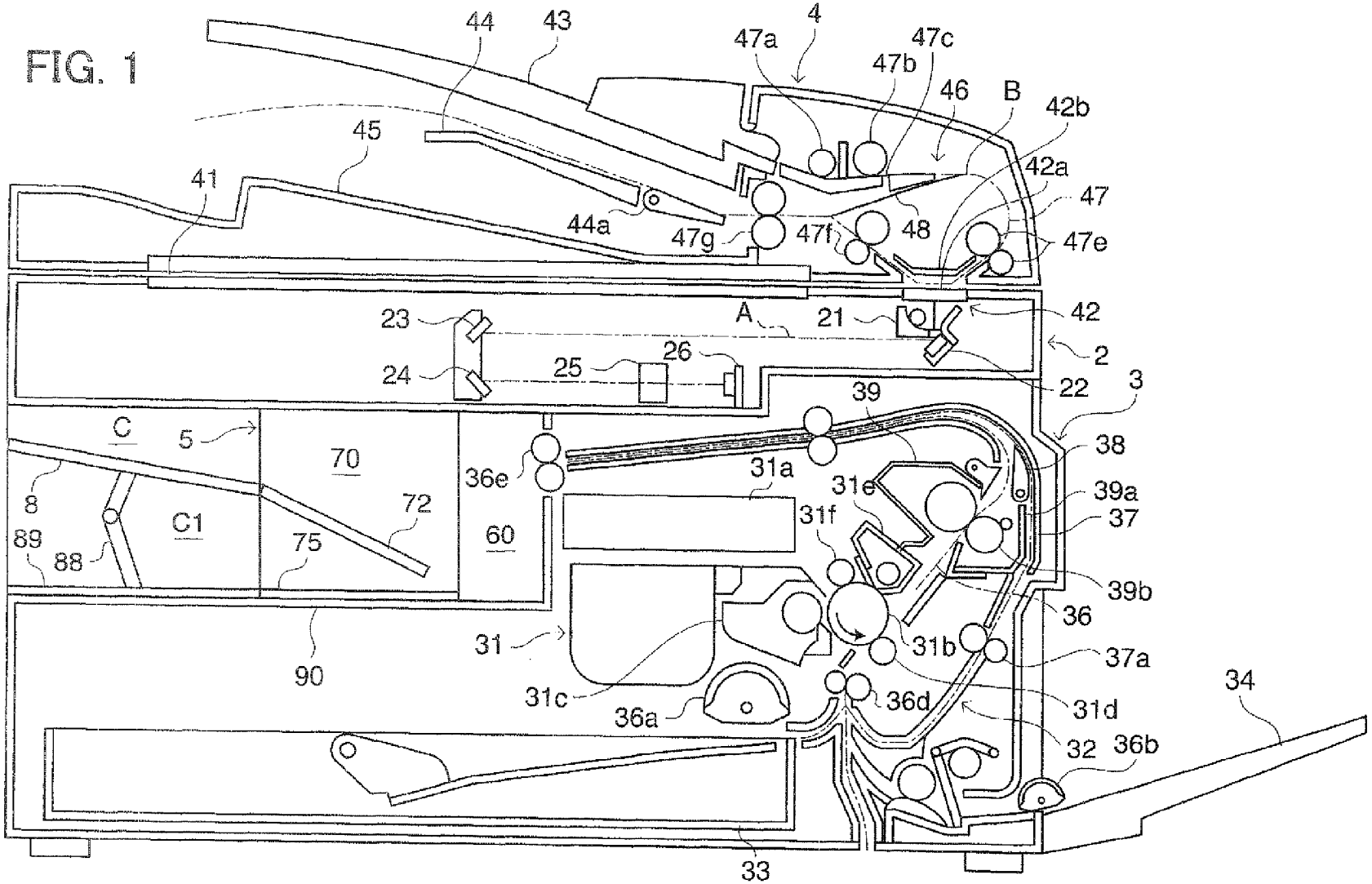
FIG. 1 is a diagram showing a schematic configuration of an image processing apparatus according to the present technology.

The image processing apparatus 1 is intended to form an image on a recording sheet (including a recording medium such as OHP) and provided with a scanner section 2, an image formation section 3, an automatic document feeding section 4 and a post-processing section 5 as shown in FIG. 1. Each mode of the image processing apparatus 1 can be selected by the user as appropriate.

For convenience of explanation, part other than the post-processing section 5 and a tray 8 of the image processing apparatus 1 will be referred to as "apparatus body".

Hereinafter, various sections of the image processing apparatus 1 will be explained and then operations of stapling processing according to the present technology will be explained.

[Configuration of Scanner Section 2]

As shown in FIG. 1, the scanner section 2 reads an image of a document placed on a document table 41 made of transparent platen glass or images of documents fed one by one by the automatic document feeding section 4 and creates document image data.

The scanner section 2 is provided with a light source for exposure 21, a plurality of reflectors 22, 23 and 24, an image-forming lens 25 and a charge coupled device (CCD) 26.

The light source for exposure 21 is intended to illuminate a document placed on the document table 41 of the automatic document feeding section 4 or a document transported through the automatic document feeding section 4.

The reflectors 22, 23 and 24 cause light reflected from the document to be reflected leftward and then downward in FIG. 1 along an optical path shown by a single-dot dashed line A in FIG. 1. Subsequently, the reflectors 22, 23 and 24 reflect the light rightward in FIG. 1 so that the light will be directed to the image-forming lens 25.

A document image is read by either of the following two methods. One of the methods involves reading a document placed on the document table 41 (when used as "sheet fixed scheme") and the other method involves a document that is being transported through the automatic document feeding section 4 (when used as "sheet transfer scheme").

When the document is read by being placed on the document table 41, the light source for exposure 21 and the reflectors 22, 23 and 24 scan in a horizontal direction along the document table 41 to read the image of the entire document.

On the other hand, when the document is read while being transported through the automatic document feeding section 4, the light source for exposure 21 and the reflectors 22, 23 and 24 are fixed at a position shown in FIG. 1 to read the image of the document when the document passes through a document reading section 42 (described later) of the automatic document feeding section 4.

After being reflected by the reflectors 22, 23 and 24 and passing through the image-forming lens 25, the light is guided to the charge coupled device 26, which then converts the reflected light into an electric signal (document image data).

[Configuration of Image Formation Section 3]

As shown in FIG. 1, the image formation section 3 is provided with an image formation system 31 as a printing section and a sheet transfer system 32 as a transfer section.

The image formation system 31 is provided with a laser scanning unit 31*a* and a photoreceptor drum 31*b* as a drum type image carrier.

The laser scanning unit 31*a* irradiates a surface of the photoreceptor drum 31*b* with a laser beam based on the document image data resulting from conversion by the charge coupled device 26 or image data inputted from an outside terminal apparatus or the like.

The photoreceptor drum 31*b* rotates in the direction shown by an arrow in FIG. 1 to form an electrostatic latent image on the surface thereof by being irradiated with the laser beam from the laser scanning unit 31*a*.

Around the outer perimeter of the photoreceptor drum 31*b*, there is provided not only a laser scanning unit 31*a*, but also a developer unit (developing mechanism) 31*c*, a transfer unit (transfer mechanism) (not shown) having a transfer roller

31*d*, a cleaning unit (cleaning mechanism) 31*e*, a static eliminator (not shown), and a charging unit (charging mechanism) (not shown) having a charge roller 31*f*. The components are disposed in the circumferential direction in the order in which they are listed above.

The developer unit 31*c* develops the electrostatic latent image formed on the surface of the photoreceptor drum 31*b* into a visual image with toner (visualizing material). The transfer roller 31*d* transfers the toner image formed on the surface of the photoreceptor drum 31*b* to a recording sheet serving as a recording medium.

The cleaning unit 31*e* removes the toner remaining on the surface of the photoreceptor drum 31*b* after the toner transfer. The static eliminator removes the remaining charge from the surface of the photoreceptor drum 31*b*. The charge roller 31*f* charges the surface of the photoreceptor drum 31*b* to a predetermined potential before the electrostatic latent image is formed.

To form an image on a recording sheet, the charge roller 31*f* charges the surface of the photoreceptor drum 31*b* to a predetermined potential and the laser scanning unit 31*a* irradiates the surface of the photoreceptor drum 31*b* with a laser beam based on document image data. The developer unit 31*c* develops a visible image by means of toner on the surface of the photoreceptor drum 31*b* and the transfer roller 31*d* transfers the toner image onto the recording sheet. After that, the toner remaining on the surface of the photoreceptor drum 31*b* is removed by the cleaning unit 31*e* and the remaining charge on the surface of the photoreceptor drum 31*b* is removed by the static eliminator.

This completes one cycle of image forming operation (printing operation) on the recording sheet. Repetition of this cycle allows images to be formed successively on a plurality of recording sheets.

The sheet transfer system 32 transfers recording sheets stored in a paper cassette 33 serving as a sheet feeding section or placed on a manual sheet feed tray 34 one by one, causes the image formation system 31 to form images and ejects the recording sheets on which images have been formed to the tray 8 via the post-processing section 5 which will be described later.

The tray 8 is provided above the paper cassette 33 and below the scanner section 2.

Figure 2:
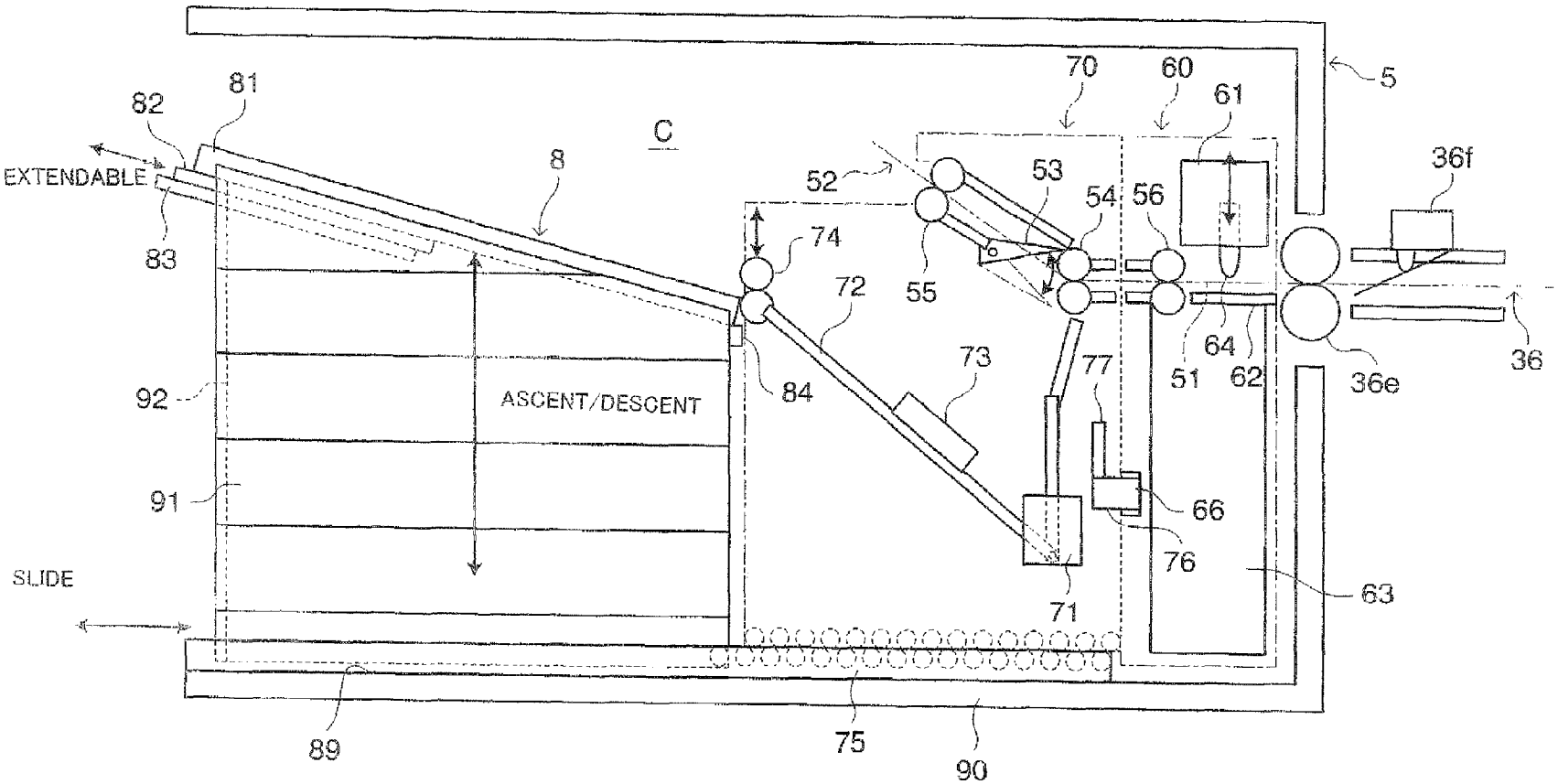
FIG. 2 is a diagram showing a schematic configuration of a post-processing section and a tray.

The sheet transfer system 32 is provided with a main transfer path 36 and an inverted transfer path 37 in the apparatus body, and a main transfer path 51 and a switchback transfer path 52 in the post-processing section 5 shown in FIG. 2.

The main transfer path 36 in the apparatus body and the main transfer path 51 in the post-processing section 5 are connected to each other, being located on opposite sides of a sheet ejection roller 36*e* of the apparatus body. The main transfer path 51 and the switchback transfer path 52 of the post-processing section 5 will be described later. In the image processing apparatus 1, the recording sheet is transferred through the sheet transfer system 32 according to a so-called central reference. That is, the recording sheet is transferred using the central position in the width direction thereof (direction orthogonal to the transfer direction of the recording sheet) as a reference.

The main transfer path 36 of the apparatus body is bifurcated at one end. One branch end faces the sheet ejection side of the paper cassette 33. The other branch end faces the sheet ejection side of the manual sheet feed tray 34. Furthermore, the other end of the main transfer path 36 faces a punching unit 60 of the post-processing section 5.

One end of the inverted transfer path 37 is connected to the main transfer path 36 upstream (lower part in FIG. 1) of the position where the transfer roller 31*d* is disposed. The other end of the inverted transfer path 37 is connected to the main transfer path 36 downstream (upper part in FIG. 1) of the position where the transfer roller 31*d* is disposed.

A pickup roller 36*a* having a semicircular section is disposed at one branch end of the main transfer path 36 (part facing the sheet ejection side of the paper cassette 33). Rotation of the pickup roller 36*a* allows recording sheets stored in the paper cassette 33 to be intermittently fed one by one to the main transfer path 36.

Likewise, a pickup roller 36*b* having a semicircular section is disposed at the other branch end (the part facing the sheet ejection side of the manual sheet feed tray 34) of the main transfer path 36. Rotation of the pickup roller 36*b* allows recording sheets placed on the manual sheet feed tray 34 to be intermittently fed one by one to the main transfer path 36.

A resist roller 36*d* is disposed upstream of the position where the transfer roller 31*d* is disposed in the main transfer path 36. The resist roller 36*d* is intended to transfer a recording sheet while aligning the toner image on the surface of the photoreceptor drum 31*b* with the recording sheet.

A fixing unit 39 provided with a pair of a heating roller 39*a* and pressure roller 39*b* for fixing the toner image transferred to the recording sheet by heat is disposed downstream of the position where the transfer roller 31*d* is disposed in the main transfer path 36. Furthermore, the sheet ejection roller 36*e* for ejecting recording sheets to the post-processing section 5 is disposed at a downstream end of the main transfer path 36 on the boundary with the main transfer path 51 of the post-processing section 5.

A branch lug 38 is disposed at a connection position at an upstream end of the inverted transfer path 37 facing the main transfer path 36. The branch lug 38 is rotatable around a horizontal axis between a first position (position shown by a solid line) in FIG. 1 and a second position where the branch lug 38 rotates counterclockwise in FIG. 1 from the first position to release the inverted transfer path 37.

When the branch lug 38 is at the first position, the recording sheet is transferred to the main transfer path 51 of the post-processing section 5. When the branch lug 38 is at the second position, the recording sheet can be supplied to the inverted transfer path 37.

A transfer roller 37*a* is disposed in the inverted transfer path 37. When a recording sheet switched back in the switchback transfer path 52 of the post-processing section 5 is supplied to the inverted transfer path 37, the recording sheet is transferred by the transfer roller 37*a*, introduced into the main transfer path 36 upstream of the resist roller 36*d* and transferred again along the main transfer path 36 toward the transfer roller 31*d*. That is, images can be formed on the back of the recording sheet.

[Configuration of Automatic Document Feeding Section 4]

As shown in FIG. 1, the automatic document feeding section 4 is configured as an automatic duplex document transfer apparatus. The automatic document feeding section 4 can be used as a sheet transfer type. The automatic document feeding section 4 is provided with a document tray 43 as a document loading section, an intermediate tray 44, a document ejection tray 45 as a document ejection section and a document transfer system 46 that transfers a document between the trays 43, 44 and 45.

The document transfer system 46 transfers the document placed on the document tray 43 to the intermediate tray 44 or the document ejection tray 45 via the document reading section 42. The document transfer system 46 is provided with a main transfer path 47 and a sub-transfer path 48 that supplies the document from the intermediate tray 44 to the main transfer path 47.

A document pickup roller 47*a* and a feeding roller 47*b* are disposed at an upstream end of the main transfer path 47 (part facing the sheet ejection side of the document tray 43). A feeding plate 47*c* is disposed below the feeding roller 47*b*. As the document pickup roller 47*a* rotates, one of the documents on the document tray 43 is fed to the main transfer path 47 by passing between the feeding roller 47*b* and the feeding plate 47*c*.

PS rollers 47*e* and 47*e* are disposed downstream of a part where the main transfer path 47 and the sub-transfer path 48 merge (part B in FIG. 1). The PS rollers 47*e* and 47*e* are intended to adjust the leading edge of the document and image reading timing of the scanner section 2 and supply the document to the document reading section 42. That is, the PS rollers 47*e* and 47*e* are designed to temporarily stop the transfer of the document when the document has been supplied, adjust the timing and supply the document to the document reading section 42.

The document reading section 42 is provided with a platen glass 42*a* and a document holding plate 42*b*. The document reading section 42 is designed to allow light from the light source for exposure 21 to pass through the platen glass 42*a* and irradiate the document when the document supplied from the PS rollers 47*e* and 47*e* passes between the platen glass 42*a* and the document holding plate 42*b*. During this time, the scanner section 2 acquires document image data.

A biasing force of a coil spring (not shown) is applied to the back (top surface) of the document holding plate 42*b*. This causes the document holding plate 42*b* to contact the platen glass 42*a* with a predetermined pressure and prevents the document from floating from the platen glass 42*a* when the document passes through the document reading section 42.

A transfer roller 47*f* and a document ejection roller 47*g* are provided downstream of the platen glass 42*a*. After passing over the platen glass 42*a*, the document is designed to be ejected to the intermediate tray 44 or document ejection tray 45 through the transfer roller 47*f* and document ejection roller 47*g*.

An intermediate tray oscillation plate 44*a* is disposed between the document ejection roller 47*g* and the intermediate tray 44. The intermediate tray oscillation plate 44*a* can oscillate around the end of the intermediate tray 44 between a position 1 (position shown by a solid line) and a position 2 flipped up from the position 1 in FIG. 1.

When the intermediate tray oscillation plate 44*a* is located at the position 2, the document ejected from the document ejection roller 47*g* is collected into the document ejection tray 45. On the other hand, when the intermediate tray oscillation plate 44*a* is located at the position 1, the document ejected from the document ejection roller 47*g* is designed to be ejected into the intermediate tray 44.

When ejected into the intermediate tray 44, the document has its edges sandwiched between the document ejection rollers 47*g* and 47*g*. When the document ejection roller 47*g* rotates backward in this condition, the document is supplied to the sub-transfer path 48, and sent out to the main transfer path 47 again via the sub-transfer path 48. The backward rotation operation of the document ejection roller 47*g* is performed by adjusting the sending of the document to the main transfer path 47 and image reading timing. This allows the document reading section 42 to read the image on the back of the document.

[Configuration of Post-Processing Section 5 and Tray Section 8]

The post-processing section 5 can perform a plurality of post-processing operations, including punching processing and stapling processing, on the recording sheets ejected from the apparatus body after completion of printing. The post-processing of sheets by the post-processing section 5 is performed when a post-processing request is contained in the input condition at the time of a printing request, which will be described later.

According to the present embodiment, as shown in FIG. 2, the post-processing section 5 and tray 8 are provided in a space C formed by the apparatus body rather than outside the apparatus body of the image processing apparatus 1. More specifically, in the apparatus body of the image processing apparatus 1, the paper cassette 33, image formation section 3 (image formation system 31) and scanner section 2 are arranged substantially in a channel shape and the post-processing section 5 and tray 8 are provided in the space C inside the channel shape formed by the apparatus body.

This allows the post-processing section 5 and tray 8 to be fitted in a limited space in the image processing apparatus 1, making it possible to perform multiple types of post-processing on recording sheets. It is also possible to reduce the area occupied by the image processing apparatus 1 provided with the post-processing section 5, and thereby realize space savings.

The post-processing section 5 and the tray 8 will now be explained in detail with reference to FIG. 2 to FIG. 6. For convenience of explanation, the transfer direction of the recording sheet (see FIG. 3) will be referred to as "sheet transfer direction" and the width direction of the recording sheet orthogonal to the sheet transfer direction (see FIG. 3) will be referred to as "sheet width direction".

As shown in FIG. 2, the post-processing section 5 is placed downstream of the sheet ejection roller 36*e* of the apparatus body as shown in FIG. 2. The post-processing section 5 includes the punching unit 60 provided with a hole-punching function and a stapling unit 70 provided with a stapling function as post-processing apparatuses.

Figure 6:
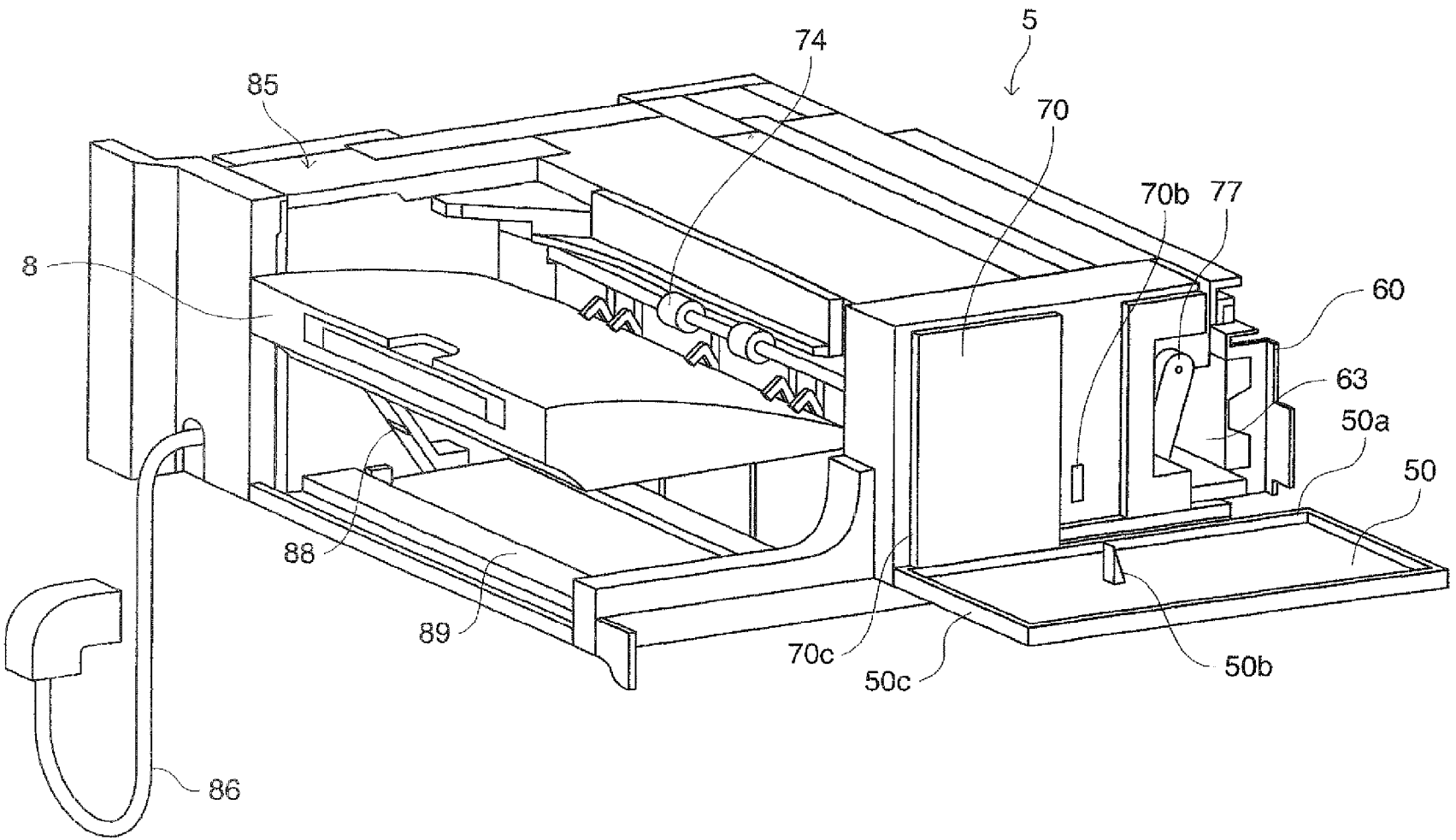
FIG. 6 is a perspective view showing the post-processing section with its cover open and the tray.

As shown in FIG. 6, the front (surface on the near side) of the post-processing section 5 is covered with a cover 50 that can be opened/closed. The punching unit 60 is disposed upstream and the stapling unit 70 is disposed downstream of the post-processing section 5.

The tray 8 is provided downstream of the post-processing section 5. A recording sheet ejected from the sheet ejection roller 36*e* is ejected onto the tray 8 via the punching unit 60 and stapling unit 70. When the stapling unit 70 of the post-processing section 5 does stapling processing, the tray 8 is used as a paper catcher for stapling processing.

Figure 7:
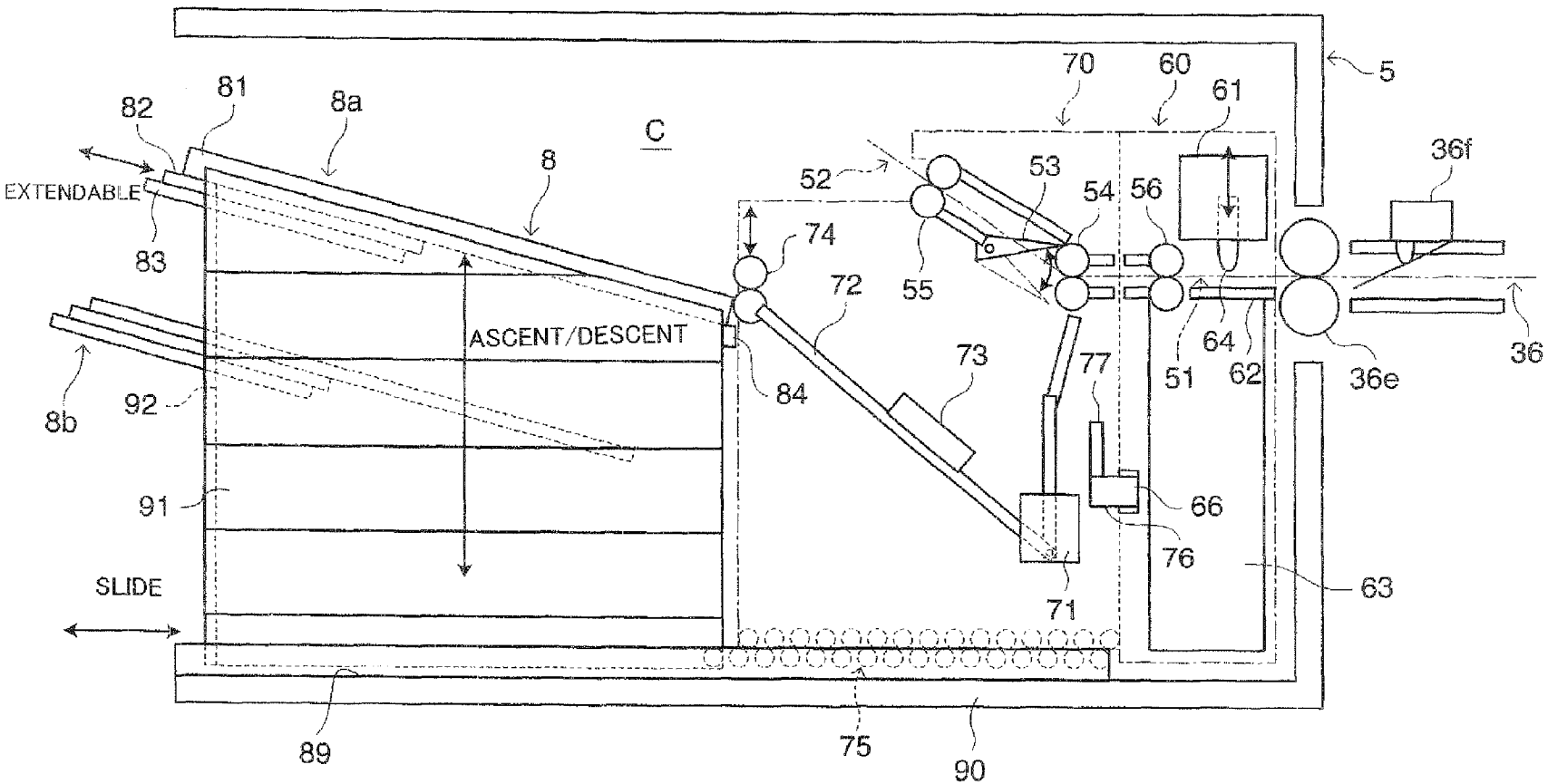
FIG. 7 is a schematic block diagram showing an image processing apparatus provided with a post-processing section and multiple trays.

Although a single tray 8 is illustrated in FIG. 2 to FIG. 6, multiple trays 8 may be provided as shown in FIG. 7. More specifically, an upper tray 8*a* and lower tray 8*b* may be provided downstream of the post-processing section 5. The upper tray 8*a* and lower tray 8*b* may each be provided with a shifter mechanism 925.

The shifter mechanism 925 is used to vary ejection speed of recording sheets onto the tray 8. That is, the shifter mechanism is intended to offset each set of recording sheets ejected onto the tray 8 at the time of sheet ejection. Details are described in Japanese Patent Laid-Open No. 2006-8370 and Japanese Patent Laid-Open No. 2004-307137.

Figure 10:
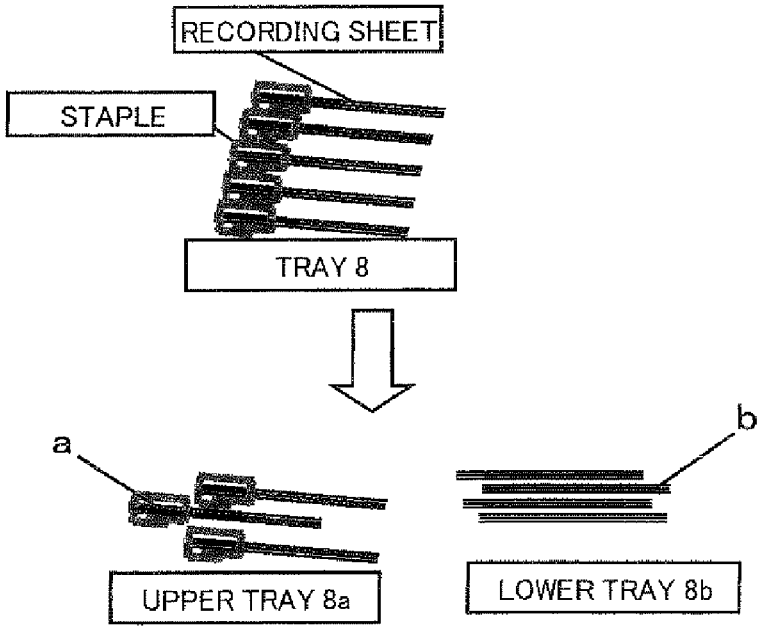
FIG. 10 is a diagram showing a two-tiered tray on which recording sheets subjected to the first processing and recording sheets subjected to the second processing are loaded into different tiers with the recording sheets in each tier being offset from each other.
Figure 9:
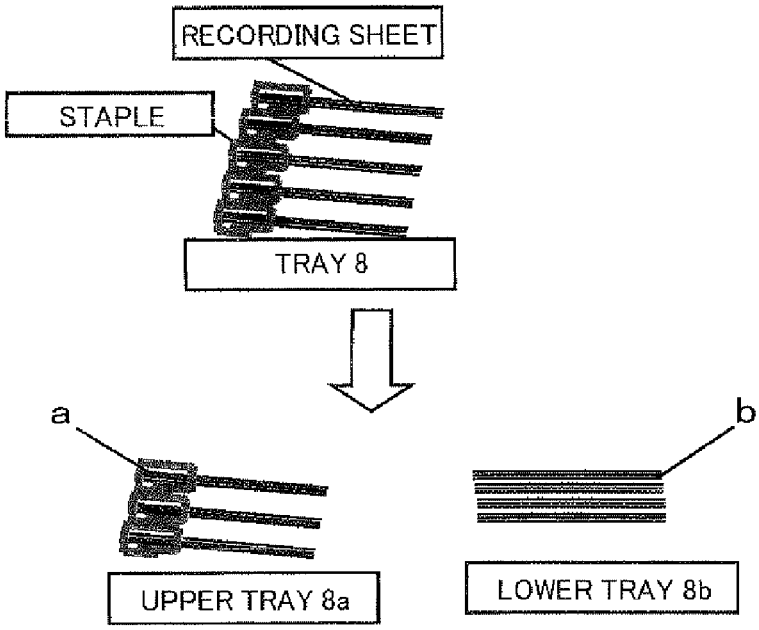
FIG. 9 is a diagram showing a two-tiered tray on which recording sheets subjected to first processing and recording sheets subjected to second processing are loaded into different tiers.

By operating the shifter mechanism 925, a control section 90 loads recording sheets onto the tray 8 by offsetting individual pieces of recording sheets from each other. When multiple trays 8 are provided, for example, when two trays 8*a* and 8*b* are provided downstream of the post-processing section 5 as shown in FIG. 9, recording sheets a subjected to first processing and recording sheets b subjected to second processing are loaded onto the different trays 8*a* and 8*b* (see FIG. 9). On each of the trays 8*a* and 8*b*, pieces of the recording sheets a or b may be loaded by being offset from each other (see FIG. 10).

Near the upstream side of the shifter mechanism 925, a branching unit is provided to branch the recording sheets to the upper tray 8*a* and lower tray 8*b*. The branching unit is provided with a switching gate to switch directions, thereby directing the recording sheets to the tray 8*a* or 8*b*.

The switching gate performs switching control based on the size of recording sheets. For that, information on the size of recording sheets is based on the detected size information of recording sheets from the paper cassette 33 and manual sheet feed tray 34.

Incidentally, recording sheets of nonstandard size might be supplied to the manual sheet feed tray 34, making it difficult to detect and determine the size of the recording sheets correctly. In such a case, during transport of the recording sheet, the length of the recording sheet may be calculated based on the time during which a pre-registration detection switch remains "ON" and the size of the recording sheet may be determined based on the calculated value.

Furthermore, recording sheets that are equal in length (the long side), but differ in width (the short side) might be transported. For example, short edge feed of A5 sheets and long edge feed of A4 sheets are a case in point. In such a case, by taking switching time of the switching gate into consideration and based on the lengths and travel times of the sheets, two paper detection switches are provided at locations separated by a distance that will allow difference between A5 width and A4 width to be detected. The two paper detection switches can be used as width reading means by being placed in such a way that the A5 width will be detected by only one of the switches and that the A4 width will be detected by both the switches.

The recording sheets ejected from the sheet ejection roller 36*e* are transported to the branching unit for the upper tray 8*a* and lower tray 8*b* via the punching unit 60 and stapling unit 70. After being sorted by the branching unit, the recording sheets are ejected to the upper tray 8*a* and lower tray 8*b* via the shifter mechanism 925.

When the recording sheets are ejected to each tray 8*a* or tray 8*b*, the shifter mechanism 925 offsets each set (bundle) of the ejected recording sheets.

If the user selects neither stapling processing nor offset processing (sorting of ejected sheets) via the operation panel, recording sheets are ejected onto the lower tray 8*b*. If the user selects stapling processing or offset processing, recording sheets are ejected onto the upper tray 8*a*. Even if the user selects stapling processing or offset processing, recording sheets that cannot be stapled because of their size are ejected onto the lower tray 8*b*.

In such cases, the user is informed, for example, in the display section (not shown) on the operation panel of the image formation apparatus, that the destination tray 8*a* or 8*b* has been changed. Alternatively, the user may be informed, without sheet ejection, that output is unavailable.

Thus, when stapling processing or offset processing is selected, recording sheets are ejected onto the upper tray 8*a* or lower tray 8*b*, whichever is selected, via the switching gate and branching unit.

[Configuration of Punching Unit 60]

The punching unit 60 punches holes (performs punching processing) in recording sheets ejected from the sheet ejection roller 36*e*.

As shown in FIG. 2, the punching unit 60 is provided with a punching mechanical section 61, a guide plate 62, a punch waste box 63 and the like. The main transfer path 51 is formed in the punching unit 60 as part of the sheet transfer system 32. The punching unit 60 is provided with a transfer roller 56 at some midpoint of the main transfer path 51.

Unlike the stapling unit 70 which will be described later, the punching unit 60 is fixed to the apparatus body.

When a request for punching processing is contained in the input condition at the time of a printing request, the punching unit 60 stops the recording sheets transferred to the punching unit 60, on the guide plate 62, and makes punch holes in the recording sheets one sheet at a time using the punching mechanical section 61. In this case, the punch holes are made at positions determined based on printing sheet size.

The punching mechanical section 61 is disposed at the top of the punching unit 60. The punching mechanical section 61 has punch pins 64 installed at two locations at a predetermined interval in the sheet width direction, the punch pins 64 being equal in diameter to punch holes.

The punch pins 64 can ascend and descend in the vertical direction. The punch pins 64 are designed to produce punch holes in the recording sheets during descent. Also, the punch pins 64 can reciprocate both along the sheet transfer direction and sheet width direction to enable alignment in preparation for punching processing, as will be described later.

The guide plate 62 is disposed under the punching mechanical section 61. Openings are formed in the guide plate 62, corresponding to predetermined punch hole locations.

As shown in FIG. 6, the punch waste box 63 is a case used to collect punch waste produced by punching processing. The punch waste box 63 is disposed below the punching unit 60, so that it can collect falling punch waste.

The punch waste box 63 can slide along the sheet width direction, so that it can be pulled out when the cover 50 is opened as will be described later. This makes it possible to remove punch waste from the punch waste box 63.

When the punching unit 60 performs punching processing, the punch pins 64 of the punching mechanical section 61 move to positions corresponding to the positions determined based on the above-described printing sheet size.

In addition, the punch pins 64 of the punching mechanical section 61 of the punching unit 60 are inched to allow punch holes to be produced precisely at positions determined based on the above-described printing sheet size, but inching is a known technique, and thus description thereof will be omitted.

[Configuration of Stapling Unit 70]

The stapling unit 70 staples recording sheets transferred from the punching unit 60 on the upstream side. The stapling unit 70 can slide in the sheet transfer direction when the cover 50 is pulled open with its inner surface up as shown in FIG. 6. Furthermore, the stapling unit 70 can be disengaged from the punching unit 60 disposed upstream of the stapling unit 70, as will be described later.

As shown in FIG. 2, the stapling unit 70 is provided with a stapling mechanical section 71, a stapling table 72, matching plates 73 and a sheet ejection roller 74. The main transfer path 51 and the switchback transfer path 52 are formed in the stapling unit 70 as part of the sheet transfer system 32.

The stapling unit 70 is provided with a branch lug 53 that switches the direction in which recording sheets are guided and a sheet ejection roller 54 that ejects the recording sheets onto the stapling table 72 at the position of connection between the downstream side of the main transfer path 51 and the upstream side of the switchback transfer path 52. A switchback roller 55 is provided downstream of the switchback transfer path 52.

When a request for stapling processing is contained in the input condition at the time of a printing request, the stapling unit 70 staples a predetermined number of recording sheets loaded on the stapling table 72 using the stapling mechanical section 71. Stapling processing is performed in the stapling unit 70 at positions determined based on the size of the recording sheet to be stapled and desired stapling position.

The "desired stapling position" refers to one or more positions where the user wants to perform stapling processing, for example, one stapling position at the top left corner or two stapling positions at the left end of the sheet and so on.

The stapling mechanical section 71 is disposed under the sheet ejection roller 54 to bind the rear end of the recording sheets loaded on the stapling table 72 with staples. The stapling mechanical section 71 can reciprocate along the sheet width direction. Consequently, stapling processing can be performed in the stapling mechanical section 71 at positions determined based on the size of the recording sheet to be stapled and desired stapling position.

When the stapling unit 70 is used for stapling processing, the stapling mechanical section 71 is moved to a position corresponding to the position determined based on the size of the recording sheet to be stapled and desired stapling position.

The stapling table 72 is intended to place the recording sheets ejected from the sheet ejection roller 54 and used as a processing table for stapling processing by the stapling mechanical section 71. The stapling table 72 is disposed with its downstream side in the sheet transfer direction inclined upward. When stapled, the recording sheet ejected from the sheet ejection roller 54 slides down under its own weights along the inclination of the stapling table 72 toward the upstream side in the sheet transfer direction. On the other hand, when not stapled, the recording sheet is ejected from the sheet ejection roller 74 to the tray 8.

The matching plates 73 are disposed on the top surface of the stapling table 72 (surface onto which recording sheets are ejected), facing each other in the sheet width direction across the stapling table 72. The pair of matching plates 73 can reciprocate along the sheet width direction. When the stapling unit 70 performs stapling processing, each recording sheet ejected onto the stapling table 72 is adjusted in the sheet width direction by moving the matching plates 73 in the sheet width direction.

The matching plates 73 are moved according to the movable width determined based on the size of the recording sheets to be stapled. The pair of matching plates 73 can be reciprocated, for example, by a rack-and-pinion mechanism.

[Configuration of Trays 8, 8*a* and 8*b*]

As shown in FIG. 2 to FIG. 7, the trays 8, 8*a* and 8*b* are provided, together with the post-processing section 5, in the channel-shaped inner space C formed by the apparatus body of the image processing apparatus 1. The recording sheets subjected to post-processing such as punching processing and stapling processing by the post-processing section 5 are ejected onto the trays 8, 8*a* and 8*b*.

Figure 3:
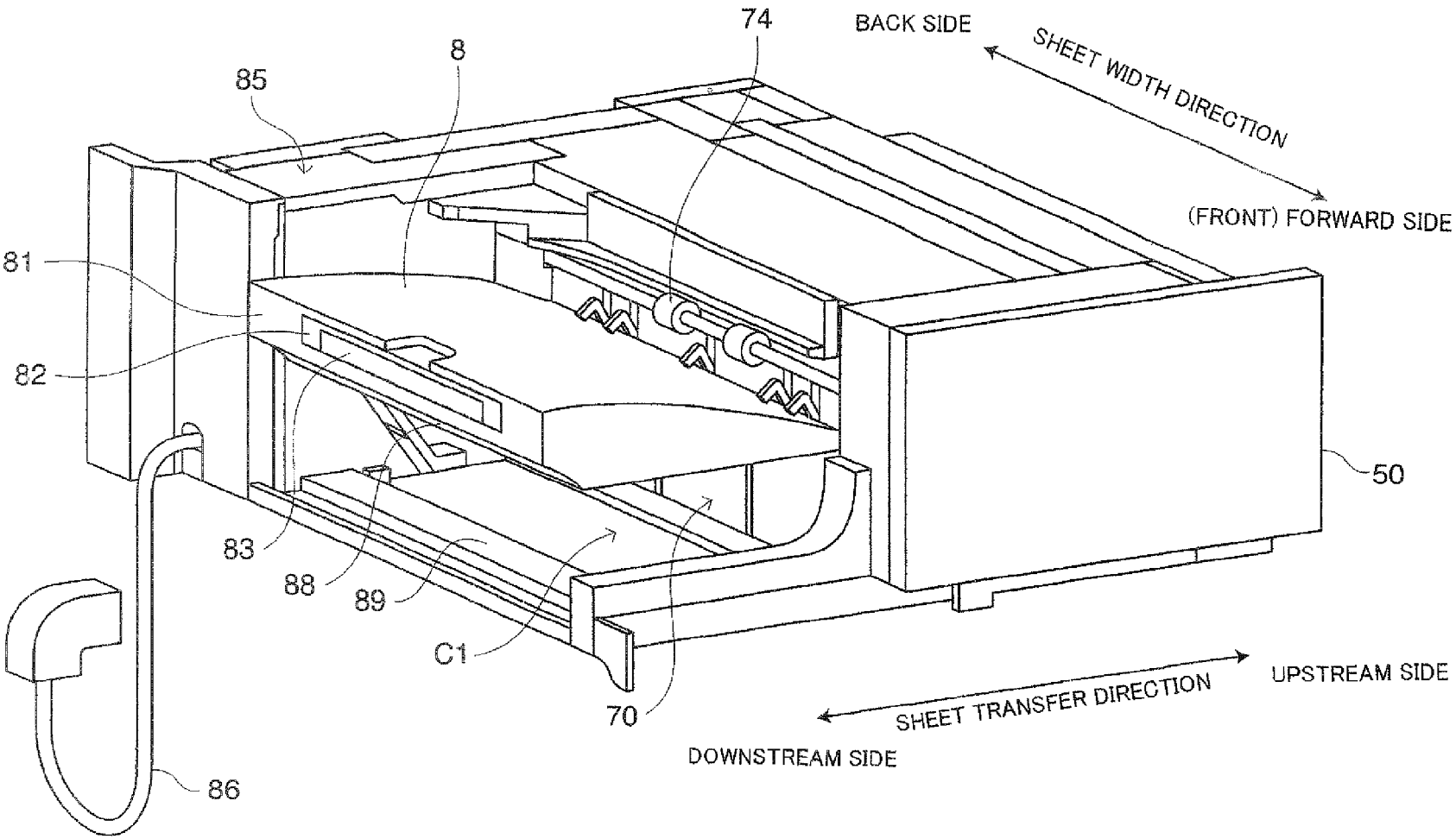
FIG. 3 is a perspective view showing the post-processing section and tray, where the tray that is extendable is retracted and elevated and a cover is closed.
Figure 4:
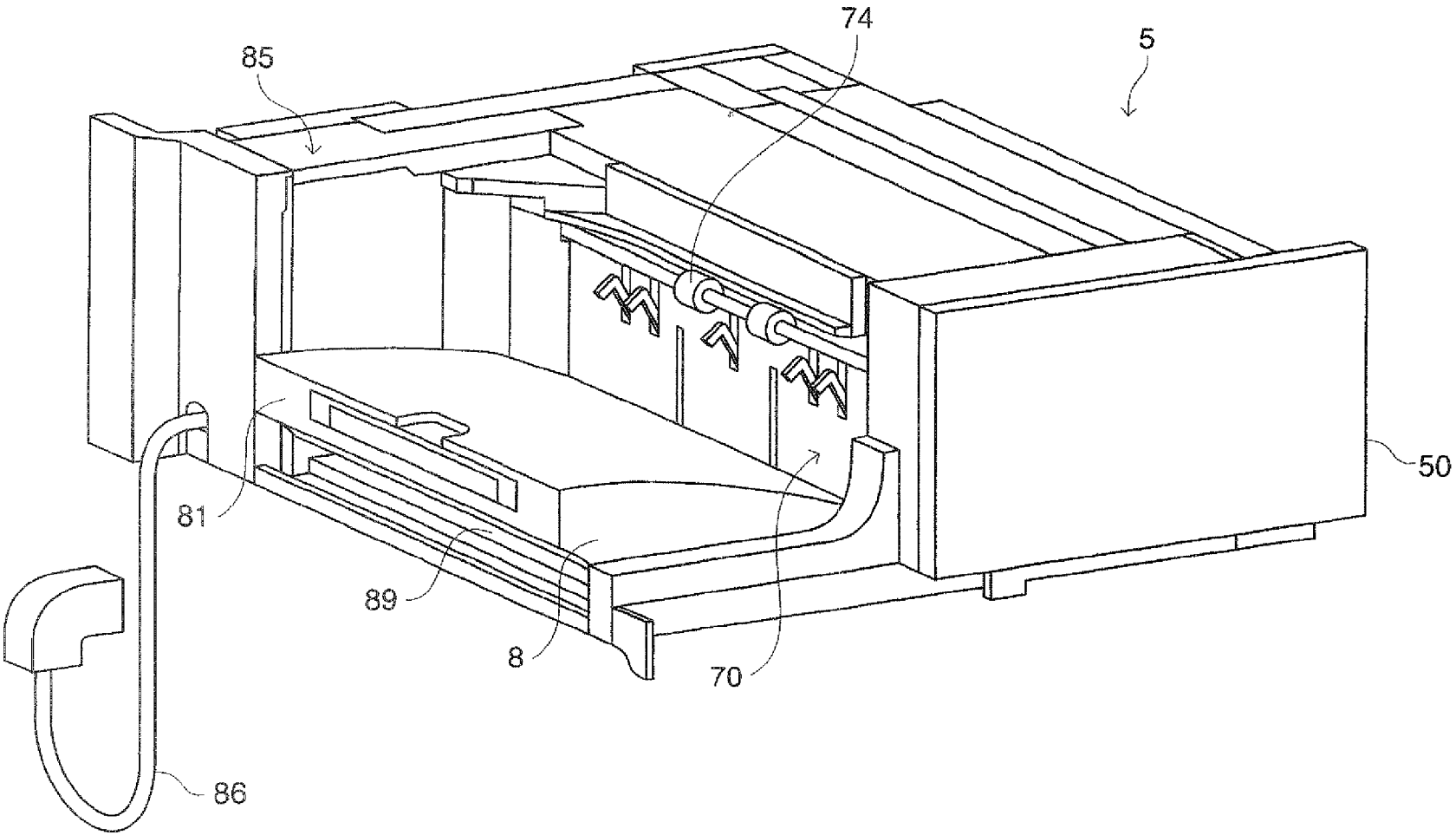
FIG. 4 is a perspective view showing an elevator tray in a lowered position and the post-processing section.
Figure 5:
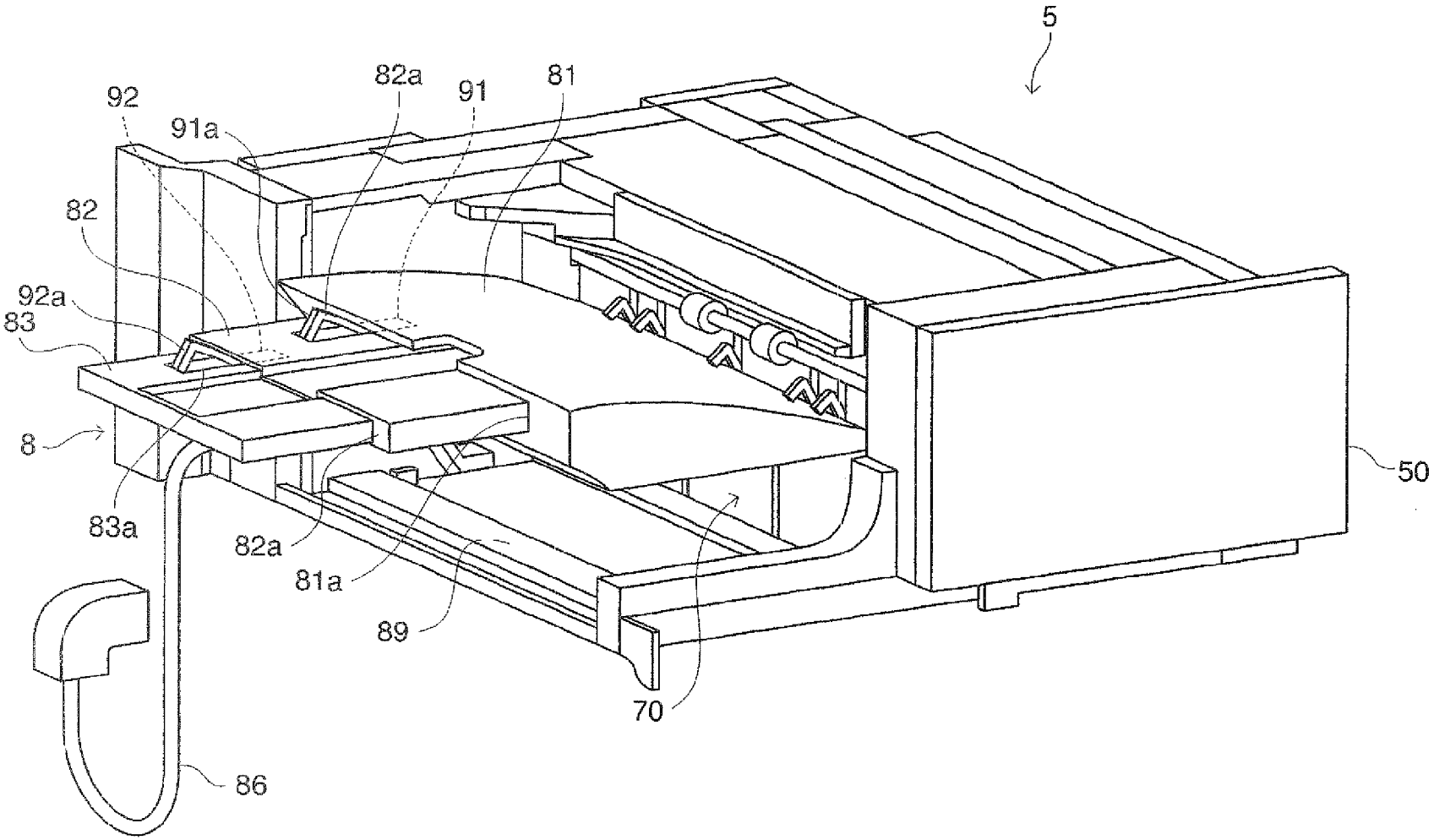
FIG. 5 is a perspective view showing an extendable tray in an extended state and the post-processing section.

As shown in FIG. 2, the trays 8, 8*a* and 8*b* can be moved upward and downward. The trays 8, 8*a* and 8*b* are slidable relative to the apparatus body. As shown in FIG. 3 and FIG. 5, the trays 8, 8*a* and 8*b* are extendable in one to three stages in the sheet transfer direction. The trays 8, 8*a* and 8*b* are configured such that the user can manually extend or retract them in the sheet transfer direction according to the size of recording sheets. The trays may be configured to be extended and retracted automatically by a motor, drive section and the like.

As shown in FIG. 5, the trays 8, 8*a* and 8*b* are provided with a first tray 81, a second tray 82 and a third tray 83.

The first tray 81 is the largest tray. The first tray 81 is located closest to the post-processing section 5. The first tray 81 is formed to such a length as not to protrude from the side (side wall) of the image processing apparatus 1. The first tray 81 is mounted integrally with the apparatus body and has a structure immobile in the sheet transfer direction.

The second tray 82 is of an intermediate size. The second tray 82 is housed in a housing part 81*a* formed in the first tray 81. The second tray 82 is designed to be able to advance and retreat along the sheet transfer direction.

The third tray 83 is the smallest tray. The third tray 83 is housed in a housing part 82*a* formed in the second tray 82. The third tray 83 is designed to be able to advance and retreat along the sheet transfer direction.

As shown in FIG. 3, when the trays 8, 8*a* and 8*b* are retracted to only one stage, the length of the trays 8, 8*a* and 8*b* along the sheet transfer direction becomes minimum. More specifically, the third tray 83 is fully housed in the second tray 82 and the second tray 82 is fully housed in the first tray 81. Along the sheet transfer direction, the trays 8, 8*a* and 8*b* are equal in length to the first tray 81, having been reduced to such a length as not to protrude from the side of the image processing apparatus 1.

This prevents the trays 8, 8*a* and 8*b* in the fully retracted state from protruding from the apparatus body and thereby allows the trays 8, 8*a* and 8*b* to be housed in the space of the apparatus body when the image processing apparatus 1 is not used.

On the contrary, when the trays 8, 8*a* and 8*b* are extended to three stages as shown in FIG. 5, the length of the trays 8, 8*a* and 8*b* in the sheet transfer direction becomes maximum. More specifically, the second tray 82 fully protrudes from the first tray 81 and the third tray 83 fully protrudes from the second tray 82. Along the sheet transfer direction, the trays 8, 8*a* and 8*b* are longer than the largest recording sheet (e.g., A3 horizontal size) printable on the image processing apparatus 1.

Consequently, when the trays 8, 8*a* and 8*b* are fully extended, recording sheets of even the largest printable size (A3 horizontal size) can be loaded in a stable manner. As will be described later, the trays 8, 8*a* and 8*b* are slidable together with the stapling unit 70, but even if the trays 8, 8*a* and 8*b* are made to slide with the recording sheets loaded, the recording sheets will not fall off the trays 8, 8*a* and 8*b*.

Since the trays 8, 8*a* and 8*b* are designed to be extendable in the sheet transfer direction, the trays 8, 8*a* and 8*b* can be adjusted to an optimal length according to the size of the recording sheet.

In the top face of the second tray 82, the opening 82*a* is formed near the proximal end of the second tray 82 and an operating lug 91*a* of a first sheet detection sensor 91 is provided, protruding upward from the opening 82*a*.

The operating lug 91*a* is constantly biased so as to protrude upward and when the second tray 82 is housed in the first tray 81, the operating lug 91*a* is pressed downward by the top surface of the inner wall of the first tray 81. When the second tray 82 is fully pulled out of the first tray 81 (see FIG. 5), the operating lug 91*a* rotates and returns to its normal position where it protrudes upward from the opening 82*a*.

According to the present embodiment, the first sheet detection sensor 91 is designed to turn "OFF" when the operating lug 91*a* protrudes upward and turn "ON" when the operating lug 91*a* is pressed downward by the top surface of the inner wall of the first tray 81.

Likewise, in the top surface of the third tray 83 an opening 83*a* is formed near the proximal end of the third tray 83 and an operating lug 92*a* of a second sheet detection sensor 92 is provided, protruding upward from the opening 83*a*. The operating lug 92*a* is constantly biased so as to protrude upward and when the third tray 83 is housed in the second tray 82, the operating lug 92*a* is pressed downward by the top surface of the inner wall of the second tray 82. When the third tray 83 is fully pulled out of the second tray 82 (see FIG. 5), the operating lug 92*a* rotates and returns to its normal position where it protrudes upward from the opening 83*a*.

According to the present embodiment, the second sheet detection sensor 92 is designed to turn "OFF" when the operating lug 92*a* protrudes upward and turn "ON" when the operating lug 92*a* is pressed downward by the top surface of the inner wall of the second tray 82. That is, the first sheet detection sensor 91 and second sheet detection sensor 92 are "OFF" when the respective trays 82 and 83 are pulled out, and in this condition, when printed recording sheets are ejected and loaded onto the respective trays 82 and 83, the operating lugs 91*a* and 92*a* are pressed downward by the loaded recording sheets, which causes the first sheet detection sensor 91 and second sheet detection sensor 92 to turn "ON". The first sheet detection sensor 91 and second sheet detection sensor 92 are designed to turn "OFF" again when the user removes the printed recording sheets from the trays 8, 8*a* and 8*b*. This makes it possible to detect whether or not there are recording sheets on the trays 8, 8*a* and 8*b*.

The first and second sheet detection sensors 91 and 92 may also be used as extension detection sensors that detect whether or not the second tray 82 and the third tray 83 are pulled out before printing starts.

That is, when the first sheet detection sensor 91 is "ON" before printing, it can be judged that the second tray 82 is not pulled out of the first tray 81. On the other hand, when the first sheet detection sensor 91 is "OFF", it can be judged that the second tray 82 is pulled out of the first tray 81. Furthermore, when the second sheet detection sensor 92 is "ON" before printing, it can be judged that the third tray 83 is not pulled out of the second tray 82. On the other hand, when the second sheet detection sensor 92 is "OFF", it can be judged that the third tray 83 is pulled out of the second tray 82.

The trays 8, 8*a* and 8*b* are configured to be able to move upward and downward as shown in FIG. 2 and FIG. 7. In this example, the trays 8, 8*a* and 8*b* are configured to move upward or downward according to the quantity (number) of recording sheets loaded.

The quantity of recording sheets ejected onto the tray 8, 8*a* or 8*b* is detected by an upper limit sensor 84 provided in the vicinity of the lower sheet ejection roller 74. The upper limit sensor 84 is a contact type sensor. When the top surface of the recording sheets loaded on the tray 8, 8*a* or 8*b* reaches a predetermined height, the upper limit sensor 84 turns "ON".

This makes it possible to detect that the tray 8, 8*a* or 8*b* is full. When the tray 8, 8*a* or 8*b* is detected to be full, the tray 8, 8*a* or 8*b* is lowered by a predetermined distance. With the descent of the tray 8, 8*a* or 8*b*, the upper limit sensor 84 turns "OFF". The quantity of recording sheets loaded on the tray 8, 8*a* or 8*b* is thus detected by the switching "ON" and "OFF" of the upper limit sensor 84.

According to the present embodiment, the highest positions of the trays 8, 8*a* and 8*b* (see FIG. 3) are designated as home positions of the trays 8, 8*a* and 8*b* and the upstream ends of the trays 8, 8*a* and 8*b* are disposed right below the sheet ejection roller 74. The trays 8, 8*a* and 8*b* are made to gradually descend as the quantity of recording sheets loaded increases. An optical sensor may be used as the upper limit sensor 84.

The trays 8, 8*a* and 8*b* are configured to be extendable. During ascent or descent of the trays 8, 8*a* and 8*b*, their second tray 82 and third tray 83 are configured to ascend or descend along with ascent or descent of the first tray 81.

As shown in FIG. 2, the ascent or descent of the first tray 81 is performed, for example, as follows. A drive section 85 is provided at the back of the first tray 81 to drive the first tray 81 upward and downward. A drive belt (not shown) is housed in the drive section 85. The drive belt can be driven by a driving power supply (not shown) connected by a wire 86. A support member for supporting the end of the first tray 81 is connected to the drive section 85. The support member is designed to perform reciprocating motion in the vertical direction, being driven via the drive belt.

Power is transmitted from the drive belt of the drive section 85 to the first tray 81 via the support member, causing the first tray 81 to ascend or descend.

An arm 88 for supporting the first tray 81 is provided below the first tray 81. The arm 88 is disposed between the first tray 81 and a bottom part 89. The arm 88 is bent into an L-shape and the bending angle is made variable. The bending angle of the arm 88 varies according to the ascent/descent position of the first tray 81.

A protrusion is provided at an end of the first tray 81 close to the post-processing section 5. The protrusion is engaged with a groove, which is provided in the post-processing section 5 extending long in the vertical direction, and is slidable in the groove.

The trays 8, 8*a* and 8*b* are each provided with a removal detection section (not shown) for detecting retrieval of ejected recording sheets. As the removal detection section, for example, a weight sensor or a mechanical detection sensor for detecting the presence/absence of recording sheets may be used.

[Configuration of Control Section 90]

Figure 8:
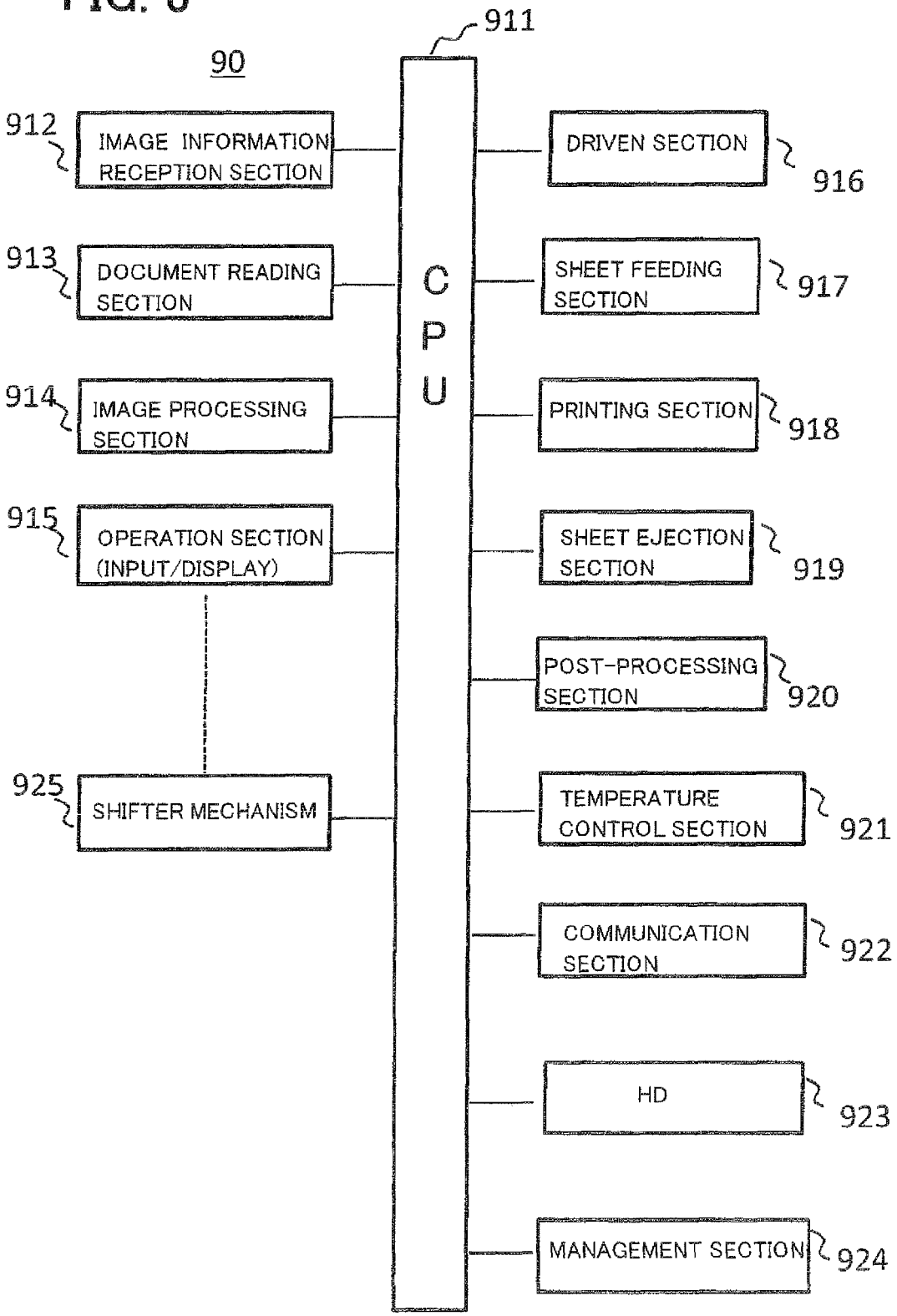
FIG. 8 is a functional block diagram showing main parts of a control section of the image processing apparatus.

FIG. 8 is a functional block diagram showing main parts of a control section 90 that contain a circuit substrate, interface substrate, and the like, where the circuit substrate controls the image formation process of the image processing apparatus 1 and the interface substrate receives image data from an outside device.

As shown in FIG. 8, centered around a CPU 911 which is a central processing unit, the control section 90 includes an image information reception section 912, a document reading section 913, an image processing section 914, an operation section (input/display section) 915, a drive section 916, a sheet feeding section 917, a printing section 918, a sheet ejection section 919, a post-processing section 920 and a temperature control section 921. Furthermore, the control section 90 also includes a communication section 922, a hard disk (HD) 923, a management section 924 and a shifter mechanism 925.

The operation section 915 includes an input section provided with various input keys and a display section such as LCD (Liquid Crystal Display). The input section receives commands related to apparatus operation and an input condition as input. The display section displays the input condition. A touch keypad of the display section combines the input section.

The input condition includes printing conditions and stapling conditions.

The printing conditions include information about the basis weight, size and orientation of recording sheets and the number of recording sheets on which images are formed as well as conditions related to the use or non-use of double-side printing, N-up printing post-processing and the like.

The stapling conditions include information on the positions of staples with respect to recording sheets, information on the orientation of staples with respect to the recording sheets, information on the number of recording sheets bound per set and mixed-processing information on first processing that involves stapling processing and second processing that does not involve stapling processing.

The control section 90 monitors operations of various sections of the image processing apparatus 1 and controls the entire apparatus based on the input condition so that the image processing apparatus 1 will operate accurately.

The communication section 922 controls communication with outside terminals such as a personal computer installed on the network.

The hard disk 923 functions as image data storing means for storing image data inputted from various input means (input paths: various modes of the digital image processing apparatus 1 including, for example, scanner, facsimile and network). The hard disk 923 can be configured as a storage apparatus provided with a magnetic storage medium.

The management section 924 manages information needed by the control section 90 to control various sections of the apparatus. When the post-processing apparatus 5 is used by being incorporated in the image processing apparatus 1, image data of a document read by the document reading section 913 is outputted from the image processing section 914 as a duplicate.

More specifically, the document reading section 913 is provided with a CCD. The document reading section 913 can electronically read an image of a document set at a reading position. The image data of the read document is completed as an output image in a volatile memory and stored temporarily on the hard disk 923. When there are a plurality of documents, the reading and storing operations are repeated.

Subsequently, the image data stored in the hard disk 923 is read sequentially at an appropriate time based on the processing mode specified via the operation section 915 and sent to the volatile memory. Then, the image data is transferred from the memory to the printing section 918 in sync with writing into the printing section 918.

Also, when multiple copies of the read image data are printed, the image data is similarly stored as output images in the hard disk 923 on a page-by-page basis, sent from the hard disk 923 to the volatile memory according to an output mode, and transferred repeatedly to the printing section 918 the number of times corresponding to the number of output copies in sync with writing.

When the image processing apparatus 1 is used as a printer, the image data received by the communication section 922 is outputted from the image processing section 914 via the memory or the like.

The communication section 922 is connected to the network via a communication cable or the like and receives image data from outside terminals such as a personal computer connected to the network. The image data received by the communication section 922 is sent to the memory on a page-by-page basis as output image data and temporarily stored in the hard disk 923. Then, the image data is sent from the hard disk 923 to the volatile memory again and transferred to the printing section 918 in the same way as when the image processing apparatus 1 is used as a copier.

When the image processing apparatus 1 is used as a network scanner, image data of a document read by the document reading section 913 can be transmitted from the communication section 922 to any personal computer or other outside terminal via the network. Again, the image of the document is electronically read using a CCD of the document reading section 913. The image data of the read document is completed as an output image in the volatile memory and temporarily stored on the hard disk 923. The image data is sent from the hard disk 923 to the volatile memory again and transmitted from the communication section 922 to a destination after communication is established with the destination specified via the operation section 915.

In addition to the network, the communication section 922 is connected to a telephone line. Consequently, when the image processing apparatus 1 according to the present embodiment is used as a facsimile apparatus, similar operations are performed and document images can be transmitted and received to/from an outside communication apparatus.

The present embodiment has been explained taking as an example the image processing apparatus 1 provided with the hard disk 923 as a storage apparatus that temporarily saves image data, but the present technology is not limited to this. The present technology is likewise applicable to a case where the image processing apparatus 1 is provided with a non-volatile memory capable of retaining stored image data even when removed from the apparatus body, memory with a backup function and other storage apparatuses (media) that use a magnetic storage medium.

The components of the image processing apparatus 1 are controlled by the control section 90. The control section 90 monitors user commands from the input section such as a tablet and key group provided in the operation section 915. Also, the control section 90 appropriately guides the user by displaying information on states of the digital image processing apparatus as well as information to be reported to the user via the display section.

The management section 924 manages information on the components managed by the control section 90. The information is used by the control section 90 to control operations of the entire image processing apparatus 1.

The control section 90 is provided with an input condition changing function. Regarding the tray 8 on which the stapled recording sheets are loaded, the input condition changing function calculates the load of recording sheets based on the input condition, judges whether or not the load is greater than a maximum load capacity and changes the input condition when the calculated load is equal to or greater than the maximum load capacity.

More specifically, the hard disk 923 stores a management table that prescribes mixed combinations of stapled and non-stapled sheets and predetermined values above which operation will be stopped, as shown in FIG. 11 to FIG. 26.

As shown in FIG. 11 to FIG. 26, the management table stores the maximum load capacity of the tray 8 based on information about stapling conditions (the positions of staples with respect to the tray 8, the number of staples and the number of recording sheets bound per set) and printing conditions (the basis weight, size and orientation of recording sheet; the number of recording sheets used for image formation; single-side printing, double-side printing, 2-in-1 printing and 4-in-1 printing and the like). Predetermined values regarding the load (bundles) on the tray 8 are determined based on the stapling conditions and printing conditions.

More specifically, management tables shown in FIG. 11 to FIG. 14 store the maximum load capacity of the tray 8 when the stapling positions are central 2 points. Management tables shown in FIG. 15 to FIG. 18 store the maximum load capacity of the tray 8 when the stapling position is back 1 point (parallel). Management tables shown in FIG. 19 to FIG. 22 store the maximum load capacity of the tray 8 when the stapling position is front 1 point (parallel). Management tables shown in FIG. 23 to FIG. 26 store the maximum load capacity of the tray 8 when the stapling position is back 1 point (diagonal).

Content of the management table will be explained taking FIG. 11 as an example. The management table shown in FIG. 11 stores the maximum load capacity of the tray 8 when the stapling positions are central 2 points on A4 size horizontal recording sheets.

Fields contained in the table include sheet size, the number of recording sheets bound per set (sheets per bundle), maximum possible output of recording sheets (thin sheets) with a basis weight less than 200 g/m$^2$ in each stapling condition (stapled sheets or non-stapled sheets), maximum possible output of recording sheets (thick sheets) with a basis weight equal to or greater than 200 g/m$^2$ in each stapling condition (stapled sheets or non-stapled sheets) and ejection-tray capacity (sheets).

For example, as shown in the top row of FIG. 11, when the sheet size is A4 horizontal, the number of recording sheets bound per set is less than 10 sheets, the recording sheets (thin sheets) used have a basis weight of less than 200 g/m$^2$; the number of sets that can be printed in each printing condition is as follows.

a) 23 sets of stapled sheets and 0 set of non-stapled sheets
b) 22 sets of stapled sheets and 2 sets of non-stapled sheets
c) 21 sets of stapled sheets and 4 sets of non-stapled sheets
d) 20 sets of stapled sheets and 6 sets of non-stapled sheets
e) 19 sets of stapled sheets and 8 sets of non-stapled sheets On the other hand, when recording sheets (thick sheets) with a basis weight equal to or greater than 200 g/m$^2$ is used, the number of sets that can be printed in each printing condition is as follows.

a) 24 sets of stapled sheets and 0 set of non-stapled sheets
b) 23 sets of stapled sheets and 2 sets of non-stapled sheets
c) 22 sets of stapled sheets and 4 sets of non-stapled sheets
d) 21 sets of stapled sheets and 6 sets of non-stapled sheets
e) 20 sets of stapled sheets and 8 sets of non-stapled sheets Regarding the ejection-tray capacity (sheets), the maximum load capacity is 240 sheets (10 sheets×24 sets) when only stapled sheets are used, and 280 sheets when a mixture of stapled and non-stapled sheets is used.

However, as shown in FIG. 11 to FIG. 26, these values vary with stapling positions, sheet size and number of recording sheets bound per set.

Incidentally, in FIG. 11 to FIG. 26, the tray capacity (bundles) for recording sheets (thin sheets) with a basis weight of less than 200 g/m$^2$ is smaller than the tray capacity (bundles) for recording sheets (thick sheets) with a basis weight equal to or greater than 200 g/m$^2$.

This is because if staples of the same length are applied, the height difference between the folded part of the staples and the surface of recording sheets tends to be larger when recording sheets (thin sheets) with a basis weight below 200 g/m$^2$ are stapled than when recording sheets (thick sheets) with a basis weight of 200 g/m$^2$ or greater are stapled (see FIG. 19(*a*)).

That is, when staples of the same length are used, in the case of recording sheets (thin sheets) with a basis weight below 200 g/m$^2$, the folded and overlapping part of the staples is larger than in the case of recording sheets (thick sheets) with a basis weight of 200 g/m$^2$ or greater, and so is the height difference between the folded part of the staples and the surface of the recording sheets. This increases the inclination of the bundles of recording sheets loaded on the tray 8, making the bundles of recording sheets more liable to slide and consequently fall off the tray 8 (see FIG. 36(*b*)).

Thus, the tray capacity (bundles) for recording sheets (thin sheets) with a basis weight of less than 200 g/m$^2$ is smaller than the tray capacity (bundles) for recording sheets (thick sheets) with a basis weight equal to or greater than 200 g/m$^2$.

Furthermore, in FIG. 11 to FIG. 26, as for recording sheets of the same size, the maximum load capacity (sheets) of the tray 8 increases as the number of recording sheets bound per set increases.

This is because, as with the above-described reason, when the number of recording sheets bound per set increases, even if staples of the same length are applied, the amount of protrusion of the staples decreases. This in turn decreases the height difference between the folded part of the staples and the surface of the recording sheets when staples are applied. Consequently, when ejected sheets are stacked, the inclination of the bundles of recording sheets becomes smaller, decreasing the frequency with which the recording sheets may collapse (see FIG. 36(*b*)). Therefore, the maximum load capacity (sheets) of the tray 8 increases as the number of recording sheets bound per set increases.

Predetermined values regarding load (bundles) on the tray 8 is determined based on the stapling conditions and printing conditions. The contents shown in the management tables in FIG. 11 to FIG. 26 are merely exemplary and are not intended to limit the present technology.

The control section 90 calculates the load of recording sheets loaded on the tray 8 based on the input condition entered via the operation section 915 or the like. The control section 90 extracts the maximum load capacity of the tray 8 from the management table based on the input condition entered via the operation section 915 or the like. The control section 90 compares the extracted maximum load capacity with the calculated load. When the calculated load is equal to or greater than the maximum load capacity, the control section 90 starts the input condition changing function.

Figure 27:
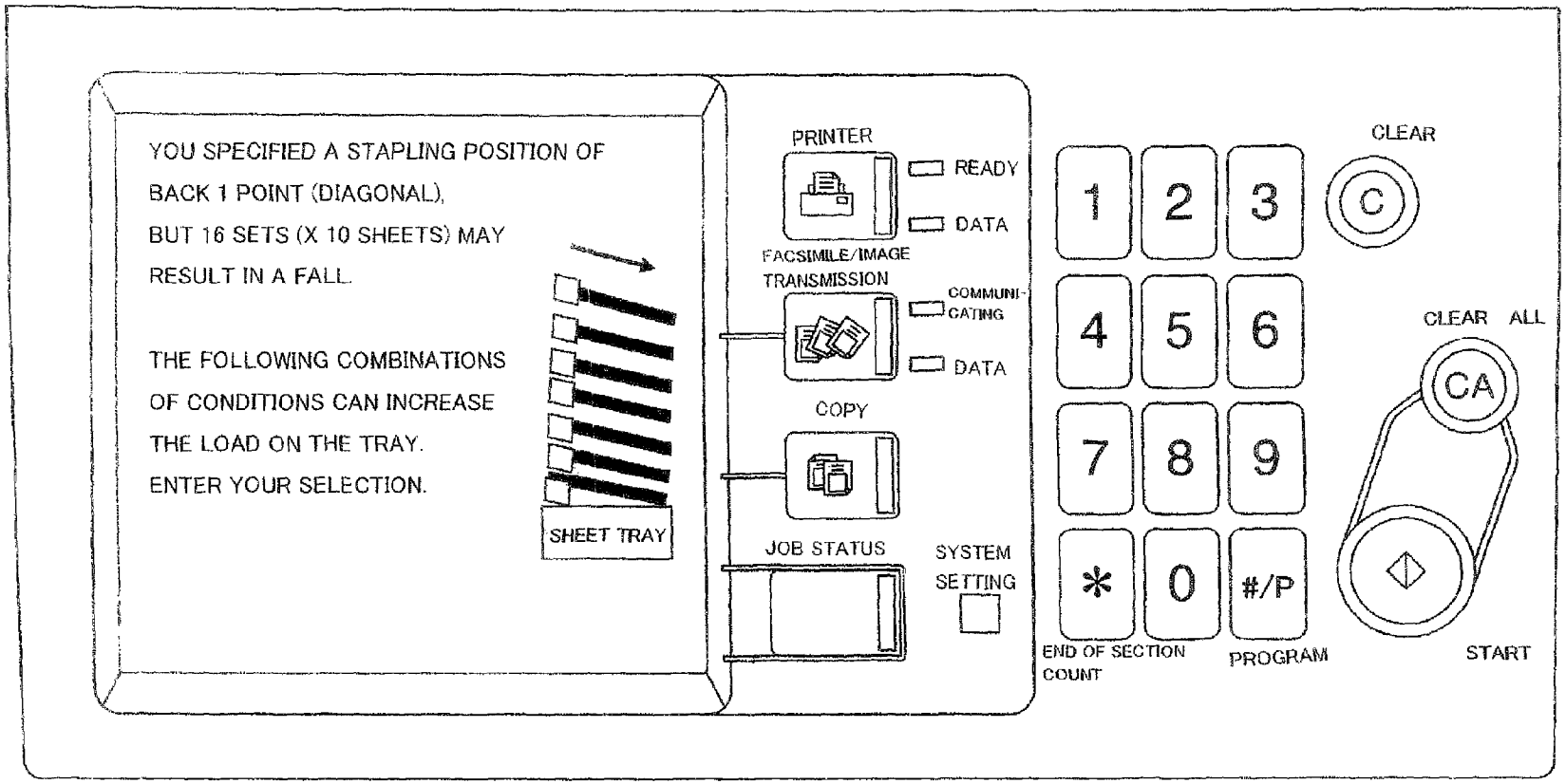
FIG. 27 is a general view of an operation panel showing an example in which a message is displayed in a display section of the operation panel.

For example, when it is judged that the calculated load exceeds the maximum load capacity, the control section 90 informs the user that processed recording sheets cannot be loaded on the tray 8 (see FIG. 27). Then, the control section 90 extracts, from the management table, input conditions which differ slightly from the input condition initially specified by the user, for example, by gradually changing the user-specified mixing ratio between recording sheets to be subjected to the first processing and recording sheets to be subjected to the second processing.

The control section 90 creates a list of the extracted input conditions and makes the display section present the list (see FIG. 28) to the user. Alternatively, by communicating with an outside terminal via the communication section 922, the control section 90 makes, for example, the display section of the outside terminal present the list of extracted conditions (see FIG. 28) to the user.

The user selects a desired input condition from the displayed list. The control section 90 changes the input condition to the selected one and starts processing.

When, for example, the selected input condition specifies A4 horizontal as sheet size, back 1 point (diagonal) as stapling position, 10 as the number of sheets per set, 200 g/m$^2$ or greater as basis weight, and 18 as the number of sets to be subjected to the first processing, and 2 as the number of sets to be subjected to the second processing, the control section 90 checks whether or not the tray 8 can meet the input condition.

More specifically, the control section 90 refers to the management table shown in FIG. 23. As shown in the management table in FIG. 23, the maximum load capacity of the tray 8 is as follows.

a) 16 sets of stapled sheets and 0 set of non-stapled sheets
b) 15 sets of stapled sheets and 2 sets of non-stapled sheets
c) 14 sets of stapled sheets and 4 sets of non-stapled sheets
d) 13 sets of stapled sheets and 6 sets of non-stapled sheets
e) 12 sets of stapled sheets and 8 sets of non-stapled sheets The maximum load capacity is 160 sheets (10 sheets×16 sets) when the sheets are stapled, and 200 sheets when stapled sheets and non-stapled sheets are mixed (stapled: 10 sheets× 12 sets; non-stapled: 10 sheets×8 sets).

Therefore, with the above-described input condition, the maximum load capacity of the tray 8 is exceeded. Consequently, the control section 90 judges that the load is greater than the maximum load capacity. Then, according to the present embodiment, by attaching importance to the user-specified stapling position of back 1 point (diagonal), the control section 90 extracts new input conditions, that is, input conditions with small variations from the input condition initially specified by the user, and presents the user with a list of the new input conditions.

For example, as shown in FIG. 28, the user is presented with a list of available sets of recording sheets for a combination of stapling conditions including stapled and non-stapled sheets.

Now, the list of conditions shown in FIG. 28 will be explained. The list of conditions in FIG. 28 shows the maximum load capacity of the tray 8 when the list is produced without changing one of the conditions initially specified by the user, namely, stapling position of back 1 point (diagonal).

Stapling conditions are shown on top of the condition list. A stapling position of back 1 point (diagonal) is specified by the input condition according to the present embodiment, and is indicated by a slant line. In the lower part of the condition list, combinations of available sets in respective printing conditions are displayed together with check-boxes.

More specifically, input conditions in the first row to the fifth row are presented.

First row: 16 sets of stapled sheets and 0 set of non-stapled sheets

Second row: 15 sets of stapled sheets and 2 sets of non-stapled sheets

Third row: 14 sets of stapled sheets and 4 sets of non-stapled sheets

Fourth row: 13 sets of stapled sheets and 6 sets of non-stapled sheets

Fifth row: 12 sets of stapled sheets and 8 sets of non-stapled sheets

The control section 90 makes changes by decreasing the sets of recording sheets subjected to first processing and increasing the sets of recording sheets subjected to second processing and presents results in sequence or presents a list of the results.

The user selects check-boxes of desired conditions from the list. The selected check-boxes are marked with slant lines (in the example of FIG. 28, the second row is selected). The control section 90 starts processing based on the selected input condition.

Consequently, all the stapled recording sheets can be loaded on the tray 8 first. After that, all the non-stapled recording sheets can be loaded on the tray 8. This makes it possible to reduce the number of operations needed to remove post-processed recording sheets from the tray 8.

When multiple trays 8*a* and 8*b* are provided, the control section 90 can load the recording sheets subjected to the first processing and recording sheets subjected to the second processing onto different trays according to the user's wishes. As described above, based on user inputs, the control section 90 ensures that the recording sheets subjected to the second processing will be ejected onto the lower tray 8*b*. The recording sheets subjected to the first processing are ejected onto the upper tray 8*a*. The control section 90 may eject recording sheets onto each tray 8*a* or 8*b* by offsetting them from each other.

When multiple trays 8*a* and 8*b* are provided, the input condition changing function is applied to each of the trays 8*a* and 8*b*. When, for example, it is judged that the calculated load exceeds the maximum load capacity of the upper tray 8*a* or the lower tray 8*b*, the control section 90 informs the user that the processed recording sheets cannot be loaded onto the tray 8*a* or 8*b*.

The control section 90 extracts, from the management table, input conditions which differ slightly from the input condition initially specified by the user, for example, by gradually changing the user-specified mixing ratio between recording sheets to be subjected to the first processing and recording sheets to be subjected to the second processing. Then, the control section 90 creates a list of the extracted input conditions and makes the display section present the list to the user. Alternatively, by communicating with an outside terminal via the communication section 922, the control section 90 presents the list to the user. The user selects a desired input condition from the displayed list. The control section 90 changes the input condition to the selected one and starts processing.

More specifically, when, for example, the selected input condition specifies A4 horizontal as sheet size, central two points as stapling positions, 10 as the number of sheets per set, 200 g/m2 or greater as basis weight, 25 as the number of sets to be subjected to the first processing, and 10 as the number of sets to be subjected to the second processing, the control section 90 checks, with reference to the management table shown in FIG. 11, whether or not the trays 8*a* and 8*b* can meet the input condition.

Under the input condition described above, as shown in FIG. 11, the maximum load capacity of each tray 8*a* or 8*b* is 240 sheets (10 sheets×24 sets) when the sheets are stapled, and 280 sheets when stapled sheets and non-stapled sheets are mixed (stapled: 10 sheets×20 sets; non-stapled: 10 sheets×8 sets).

Therefore, with the above-described input condition, the maximum load capacity of the upper tray 8*a* is exceeded. Consequently, the control section 90 judges that the load is greater than the maximum load capacity. Then, the control section 90 creates new input conditions with small variations from the input condition initially specified by the user and presents the user with the new input conditions.

According to the present embodiment, by attaching importance to the stapling position of back 1 point (diagonal) specified by the user, the control section 90 creates a list of new input conditions extracted based on the user-specified input condition and presents the list to the user. For example, the control section 90 presents the following list of input conditions.

a) 24 sets of stapled sheets and 2 sets of non-stapled sheets
b) 22 sets of stapled sheets and 3 sets of non-stapled sheets
c) 21 sets of stapled sheets and 3 sets of non-stapled sheets
d) 20 sets of stapled sheets and 4 sets of non-stapled sheets The control section 90 makes changes by decreasing the recording sheets to be subjected to the first processing and increasing the recording sheets to be subjected to the second processing and presents results in sequence or presents a list of the results.

Under these conditions, part of the recording sheets subjected to the first processing can be loaded onto the trays 8*a* and 8*b* first. After that, all the recording sheets subjected to the second processing can be loaded onto the trays 8*a* and 8*b* together with any remaining recording sheets subjected to the first processing. This makes it possible to reduce the number of operations needed to remove finished recording sheets from the trays 8*a* and 8*b*.

Incidentally, even if the user has specified the number of sets of recording sheets to be subjected to the first processing and the number of sets of recording sheets to be subjected to the second processing, the control section 90 may extract multiple combinations of slightly different printing conditions which vary stepwise from the specified values and then present a list of the printing conditions.

Next, processing operation performed by the control section 90 in response to a printing request will be explained with reference to a flowchart in FIG. 29 to FIG. 34.

Figure 29:
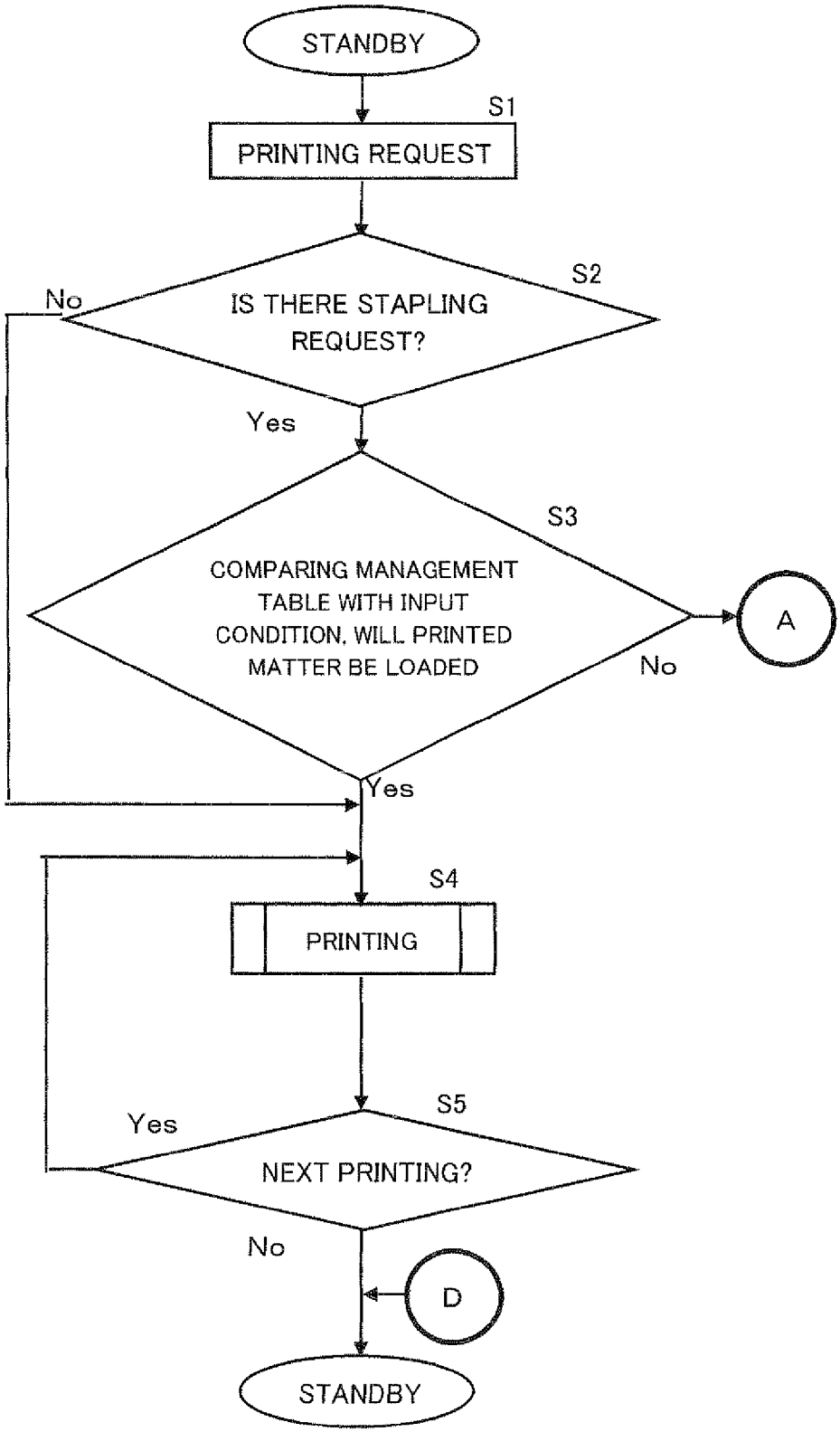
FIG. 29 is a flowchart showing processing operations when a single tray is used.
Figure 30:
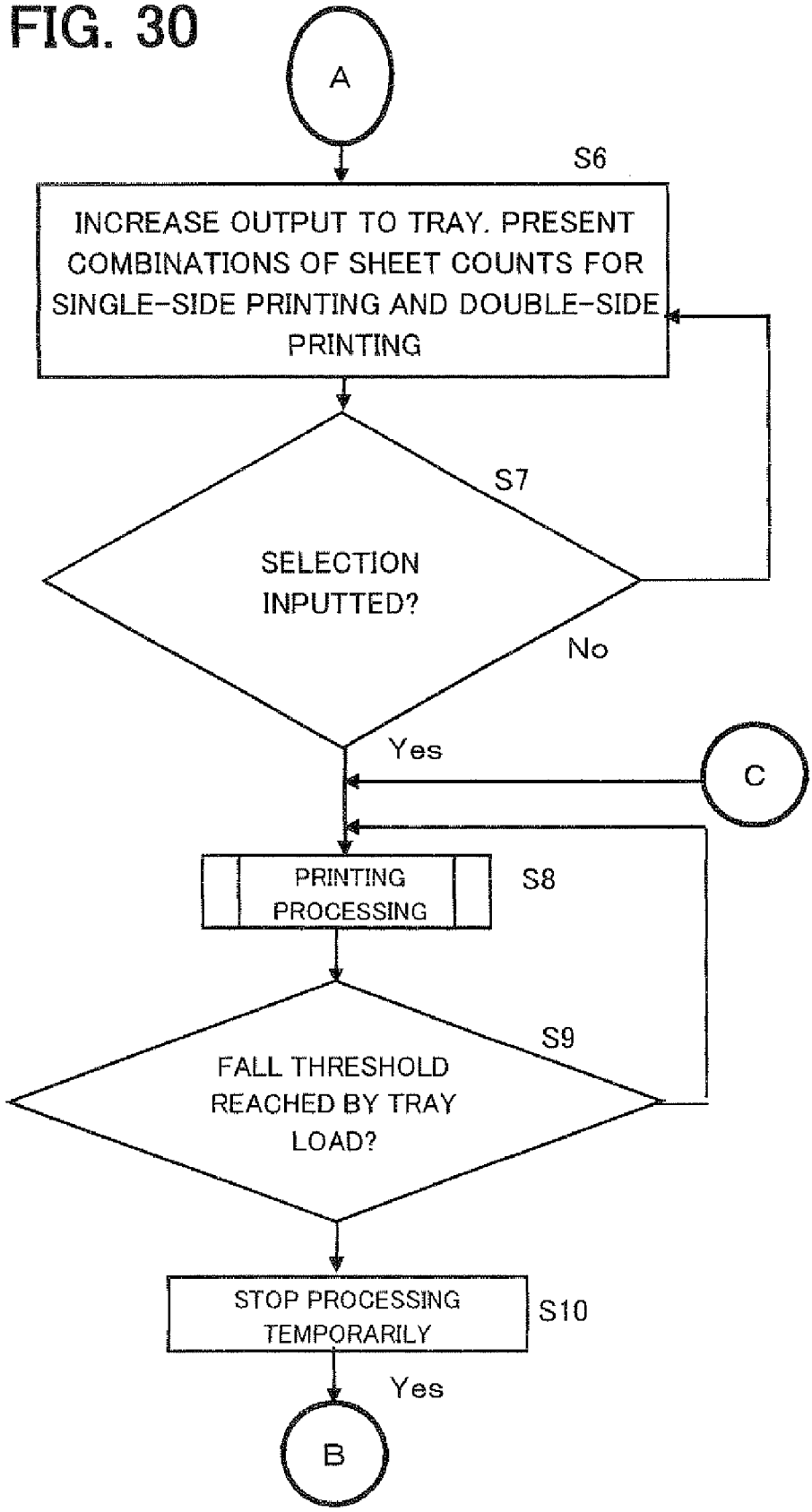
FIG. 30, which is continued from FIG. 29, is a flowchart showing processing operations when a single tray is used.
Figure 31:
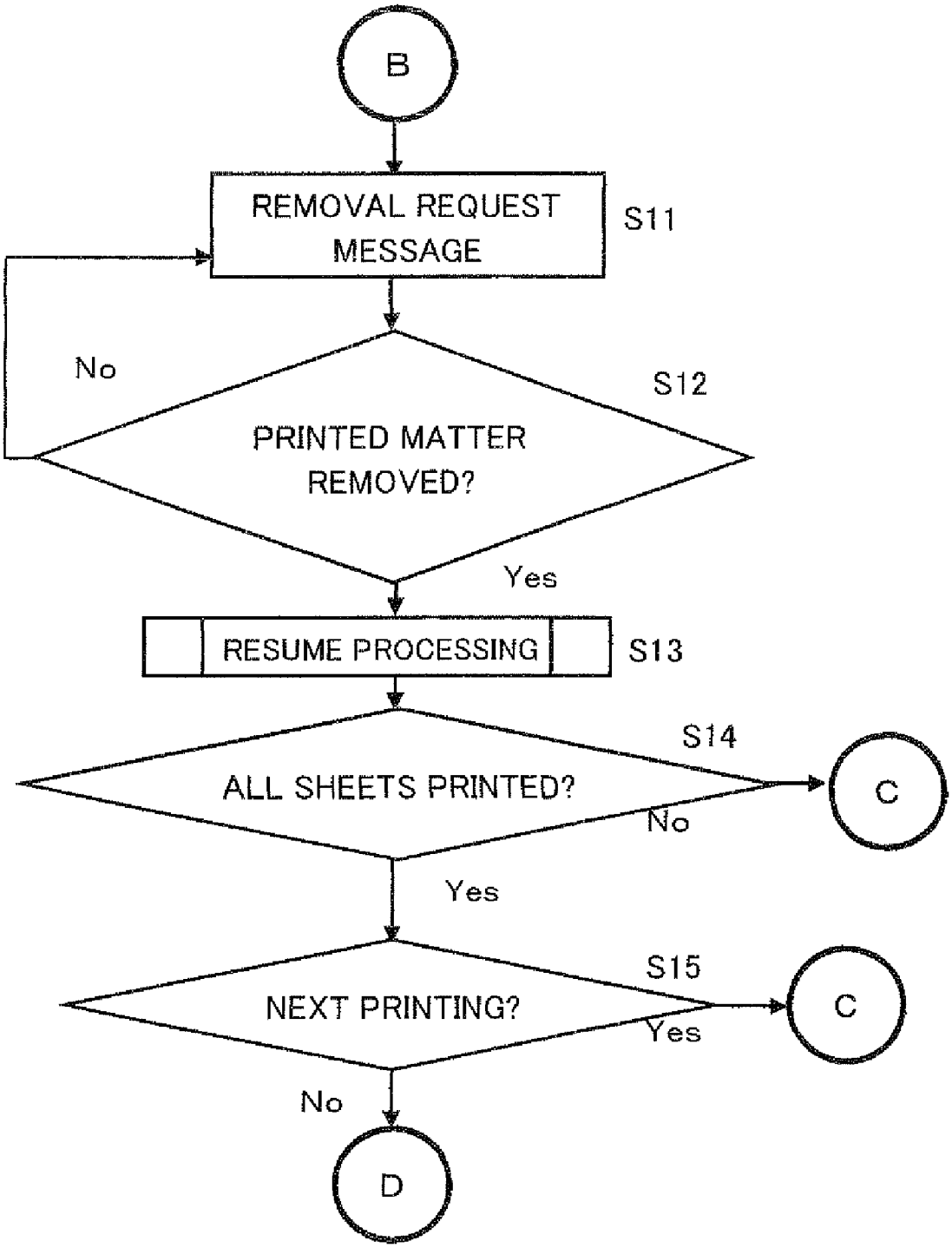
FIG. 31, which is continued from FIG. 30, is a flowchart showing processing operations when a single tray is used.

First, with reference to FIG. 29 to FIG. 31, description will be given of a case in which the post-processing apparatus 5 is provided with a single tray 8. For convenience of explanation, it is assumed that the input condition includes mixed-processing information.

When the user makes a printing request by specifying various printing conditions and stapling conditions to be included in the input condition via the operation section (S1), the control section 90 checks whether or not the entered printing request contains a stapling processing request for recording sheets (S2).

When there is a stapling processing request (Yes in S2), the control section 90 judges, with reference to the management table, whether or not the processed recording sheets will fall off the tray 8 (S3).

Upon judging that the recording sheets will not fall off the tray 8 (Yes in S3), the control section 90 starts printing processing based on the entered input condition (S4), performs printing processing and stapling processing to the last and loads the recording sheets subjected to the first processing and the recording sheets subjected to the second processing onto the tray 8 (S5). When the processing ends, the control section 90 checks whether or not there is a next printing request. If there is no more printing request, the control section 90 enters a standby state.

When there is no stapling request (No in S2), the control section 90 starts the printing processing directly (S4) and performs printing processing to the last (S5). When the printing ends, the control section 90 checks whether or not there is a next printing request. If there is no more printing request, the control section 90 enters a standby state.

If it is judged with reference to the management table in S3 that under the entered input condition, the recording sheets will fall off the tray 8, the control section 90 extracts a plurality of optimal input conditions from the management table, without changing the original input condition greatly, so that recording sheets can be loaded most efficiently on the tray 8, and displays a list of the extracted input conditions (S6).

Although according to the present embodiment, conditions are displayed starting with a condition with small variations from the input condition specified by the user, the present technology is not limited to this.

The user selects one of the displayed input conditions. The control section 90 checks the input condition selected from the displayed input conditions (S7). After checking content of the mixed-processing information (the number of recording sheets to be subjected to the first processing and the number of recording sheets to be subjected to the second processing) contained in the input condition, the control section 90 performs printing processing and stapling processing (S8).

When there is no desired input condition and the user does not select any input condition, the control section 90 returns to S6 to extract and display different input conditions. The control section 90 repeats this operation until the user selects an input condition. When the user selects any input condition, the control section 90 checks the input condition selected from the displayed input conditions (S7), checks content of the mixed-processing information (the number of recording sheets to be subjected to the first processing and the number of recording sheets to be subjected to the second processing) contained in the selected input condition, and then performs printing processing and stapling processing (S8), in the manner described above.

The control section 90 performs the first processing. Recording sheets produced by the first processing are ejected onto the tray 8. The control section 90 checks the number of the recording sheets ejected onto the tray 8 and judges whether or not the number specified for the first processing has been reached. To judge whether or not the number specified for the first processing has been reached, the number specified for the first processing is stored, for example, in a temporary memory (not shown) and the number of sheets ejected onto the tray 8 is compared with the number stored in the temporary memory.

If the number of ejected sheets has not reached the number specified for the first processing, the control section 90 continues processing until the number of ejected sheets reaches the number specified for the first processing (S8). When the number specified for the first processing is reached, the control section 90 starts the second processing.

Figure 35:
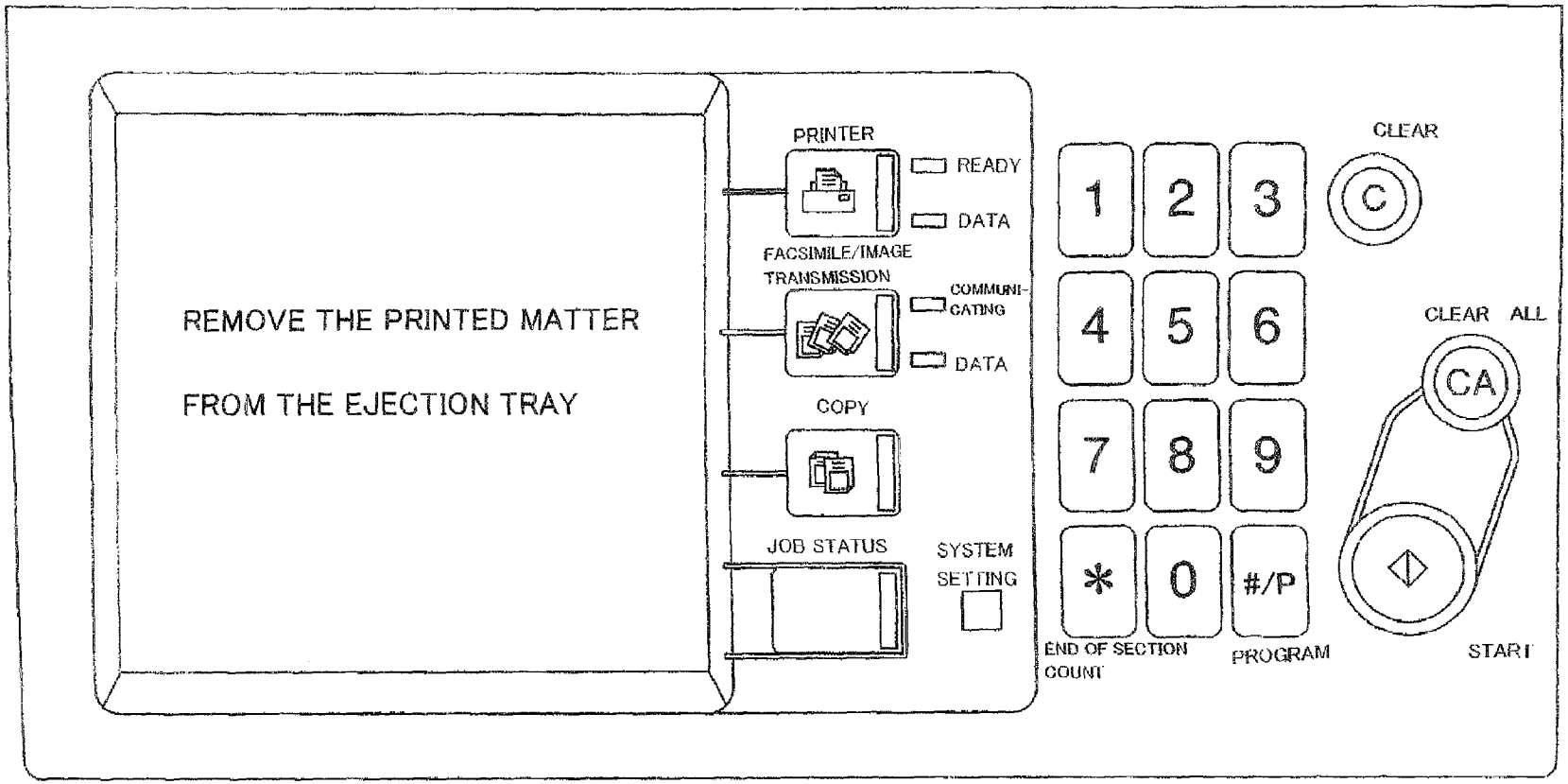
FIG. 35 is a general view of the operation panel showing an example in which a message is displayed in the display section.

Based on input from the upper limit sensor 84, the control section 90 checks whether or not the maximum load capacity of the tray 8 has been reached (S9). If the maximum load capacity has not been reached, the control section 90 continues processing until the maximum load capacity is reached (S8). When the maximum load capacity is reached, the control section 90 temporarily stops processing (S10). Then, the control section 90 prompts the user to remove the finished recording sheets from the tray 8 as shown in FIG. 35.

The control section 90 detects whether the ejected recording sheets has been removed from the tray 8, using the removal detection section. The control section 90 continues prompting the user to remove the recording sheets from the tray 8 until removal of the recording sheets is detected. When removal of the recording sheets is detected, the control section 90 resumes processing (S13).

After resuming processing, the control section 90 checks whether or not all processing is finished (S14). If all the processing is not finished, the control section 90 returns to S8 to continue processing. The control section 90 repeats S8 to S14 until all the processing is finished.

When all the processing is finished (Yes in S14), the control section 90 checks whether or not there is a next printing request (S15). If there is a next printing request, the control section 90 repeats S8 to S15 based on the input condition related to the printing request. If there is no printing request, the control section 90 enters a standby state.

As described above, the present embodiment makes it is possible to load recording sheets onto the tray most efficiently and reduce the frequency with which post-processed recording sheets are removed from the tray. Therefore, the present embodiment can improve the operating efficiency and reliably prevent processed recording sheets from falling.

Figure 32:
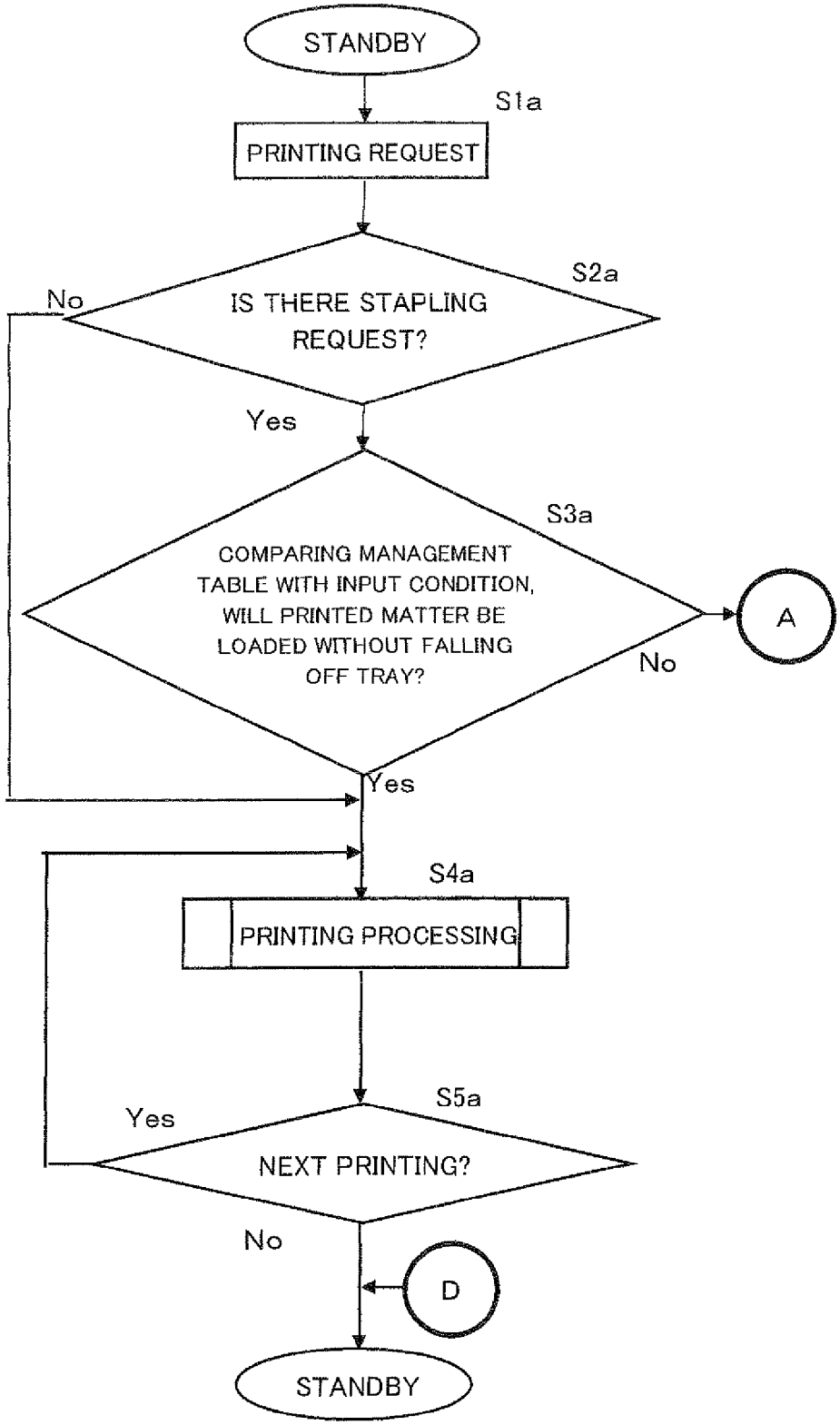
FIG. 32 is a flowchart showing processing operations when two trays are used.

Next, with reference to FIG. 32 to FIG. 34, description will be given of a case in which the post-processing apparatus 5 is provided with two trays: an upper tray 8*a* and lower tray 8*b*. For convenience of explanation, it is assumed that the input condition includes mixed-processing information. Recording sheets subjected to the first processing are loaded onto the upper tray 8*a* and recording sheets subjected to the second processing is loaded onto the lower tray 8*b*.

Figure 33:
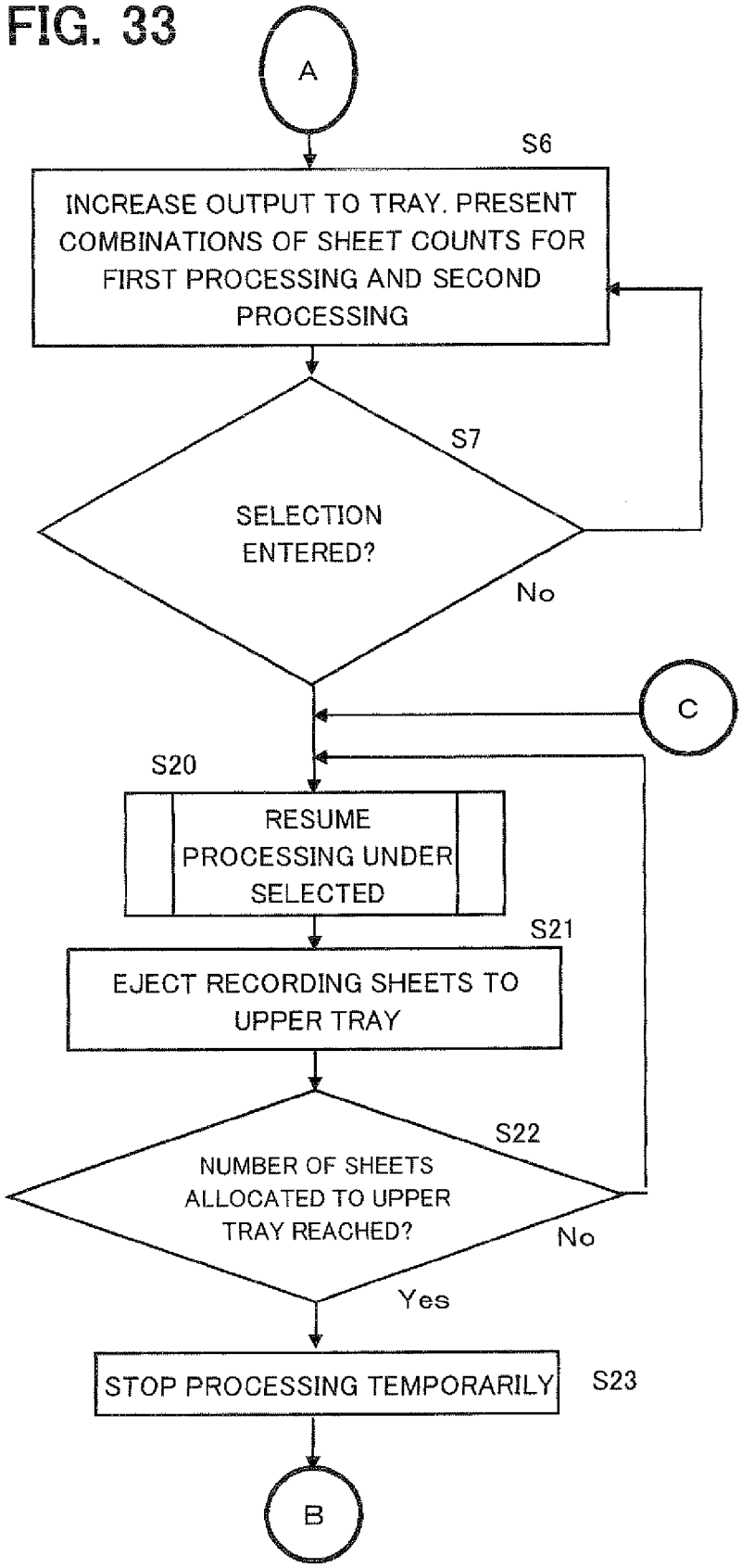
FIG. 33, which is continued from FIG. 32, is a flowchart showing processing operations when two trays are used.
Figure 34:
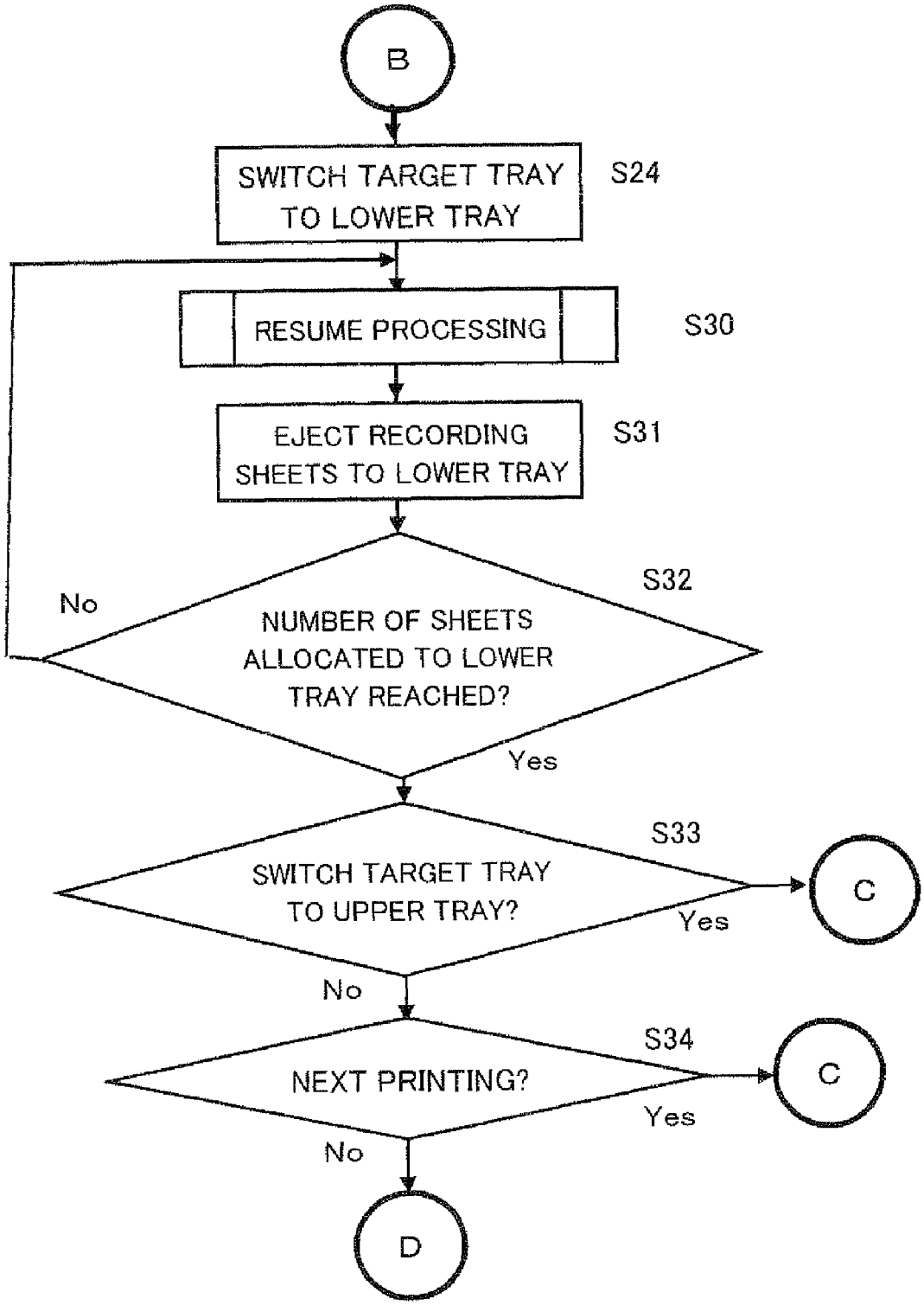
FIG. 34, which is continued from FIG. 33, is a flowchart showing processing operations when two trays are used.

Processes of S1*a* to S5*a* in FIG. 32 and S6 to S7 in FIG. 33 are the same as in the case where the post-processing apparatus 5 is provided with a single tray 8 (see FIG. 29 and FIG. 30), and thus description of processing operations thereof will be omitted and only processing operations in S20 and later will be described.

The control section 90 checks content of the mixed-processing information (the number of recording sheets to be subjected to the first processing and the number of recording sheets to be subjected to the second processing) contained in the input condition and then performs printing processing and stapling processing (S20).

The control section 90 performs the first processing. The recording sheets subjected to the first processing are ejected onto the upper tray 8*a* (S21). The control section 90 checks the number of recording sheets ejected onto the upper tray 8*a* and judges whether or not the number specified for the first processing has been reached (S22). To judge whether or not the number specified for the first processing has been reached, the number specified for the first processing is stored, for example, in a temporary memory (not shown) and the number of sheets ejected onto the upper tray 8*a* is compared with the number stored in the temporary memory. Incidentally, the control section 90 also checks whether or not the maximum load capacity of the upper tray 8*a* has been reached, based on input from the upper limit sensor 84.

If the maximum load capacity has not been reached and the number specified for the first processing has not been reached, the control section 90 continues processing until the maximum load capacity is reached or until the number specified for the first processing is reached (S20).

When the maximum load capacity is reached or when the number specified for the first processing is reached, the control section 90 temporarily stops processing (S23). Then, the control section 90 prompts the user to remove the finished recording sheets from the upper tray 8*a* (see FIG. 35).

With the processing stopped temporarily, the control section 90 switches the target tray from the upper tray 8*a* to the lower tray 8*b* using a switching section (S24). The control section 90 informs the user that the target tray has been switched to the lower tray 8*b*. This allows the user to reliably remove the finished recording sheets from the upper tray 8*a* under stable conditions. Now, the control section 90 can change the position of the upper tray 8*a*.

The control section 90 resumes processing (S30). The processed recording sheets are ejected to the lower tray 8*b* (S31) to which the target tray has been switched. This time, the control section 90 does the second processing. Consequently, the recording sheets subjected to the second processing are ejected onto the lower tray 8*b*. The number of sheets ejected onto the lower tray 8*b* is calculated in the same manner as in the case of the upper tray 8*a*. Also, the control section 90 checks whether or not the maximum load capacity of the lower tray 8*b* has been reached.

If the maximum load capacity has not been reached and the number specified for the second processing has not been reached, the control section 90 continues processing until the maximum load capacity is reached or until the number specified for the second processing is reached (S30).

When the maximum load capacity of the lower tray 8*b* is reached or when the number specified for the second processing is reached, the control section 90 temporarily stops processing (S23). Then, the control section 90 prompts the user to remove the finished recording sheets from the lower tray 8*b*.

The control section 90 judges whether to change the target tray to the upper tray 8*a* again (S33). For example, if the target tray has been switched from the upper tray 8*a* to the lower tray 8*b* because the maximum load capacity of the upper tray 8*a* has been reached, the control section 90 needs to eject recording sheets subjected to the first processing onto the upper tray 8*a* again. That is, if the number specified for the first processing has not been reached (Yes in S33), the control section 90 returns to S20. Incidentally, when returning to S20, the control section 90 temporarily stops processing as in the case of S23.

When returning from S33 to S20 or when going from S33 to S34, the control section 90 detects whether or not the recording sheets has been removed from the tray 8*a* or 8*b*, using the removal detection section.

Preferably, a removal request message that prompts the user to remove the recording sheets from the trays 8*a* and 8*b* is issued between S30 and S32. That is, when ejection to the upper tray 8*a* is finished and the target tray is changed to the lower tray 8*b* or when ejection to the lower tray 8*b* is finished and the target tray is changed to the upper tray 8*a*, the control section 90 informs the user about the change of the target tray. The removal request message of recording sheets can, for example, be displayed in the display section or provided in the form of warning sound or warning voice using sound-producing means (not shown).

Consequently, when removal of recording sheets from the upper tray 8*a* or lower tray 8*b* is detected, the control section 90 can continue subsequent processing. Also, the user can reliably remove recording sheets from the upper tray 8*a* while recording sheets are being ejected onto the lower tray 8*b*. Furthermore, following the ejection onto the lower tray 8*b*, the control section 90 can eject recording sheets onto the upper tray 8*a* continuously again.

When removal of recording sheets from the upper tray 8*a* is detected, the ejection of recording sheets is switched again from the lower tray 8*b* to the upper tray 8*a*. Also, when removal of recording sheets from the lower tray 8*b* is detected, the ejection of recording sheets is switched again from the upper tray 8*a* to the lower tray 8*b*.

More specifically, when switching from the upper tray 8*a* to the lower tray 8*b*, before removal of recording sheets from the upper tray 8*a* is detected, the control section 90 does not continue to eject recording sheets after the lower tray 8*b*.

When switching from the lower tray 8*b* to the upper tray 8*a* (S20 and S22) in a switching sequence from the upper tray 8*a* to the lower tray 8*b* and to the upper tray 8*a*, before removal of recording sheets from the upper tray 8*a* is detected, the control section 90 does not continue to eject recording sheets after the lower tray 8*b*.

Consequently, only after confirming removal of recording sheets from the tray 8*a* or 8*b*, the control section 90 subsequently continues ejection. This makes it possible to reliably prevent recording sheets from being accumulated and thereby causing an ejection jam.

When recording sheets are ejected in a divided manner, if removal of recording sheets from the tray 8*a* or 8*b* is not detected, preferably subsequent processing is stopped temporarily. Thus, if removal of recording sheets from the tray 8*a* or 8*b* cannot be detected, subsequent processing is stopped. This allows the post-processing apparatus 5 to reliably prevent ejection jams.

When there is a large number of recording sheets to be ejected, after ejection of recording sheets onto the trays 8*a* and 8*b*, when ejection onto the lower tray 8*b* is finished and the target tray is changed to the upper tray 8*a* (Yes in S33), preferably a removal request message is issued in a subsequent step between S20 and S22, prompting the user to remove the recording sheets from the lower tray 8*b*.

This makes it possible to remove recording sheets from the upper tray 8*a* while recording sheets are being ejected onto the lower tray 8*b* and thereby eject recording sheets onto the upper tray 8*a* continuously, following the ejection onto the lower tray 8*b*.

If the number specified for the first processing has not been reached (No in S33), the control section 90 goes to S34. The control section 90 checks whether or not there is a next printing request (S34). If there is a next printing request, the control section 90 returns to S20 to start processing again. If there is no printing request, the control section 90 enters a standby state.

When multiple trays 8*a* and 8*b* are provided as described above, the recording sheets subjected to the first processing and the recording sheets subjected to the second processing can be ejected onto different trays 8*a* and 8*b*. This allows the user to sort recording sheets easily. Also, if the processed recording sheets are offset when being ejected onto the trays 8*a* and 8*b*, the sorting will become still easier.

When ejecting recording sheets onto each tray 8, 8*a* or 8*b*, the control section 90 can offset the recording sheets. For example, when a single tray 8 is used, the control section 90 offsets the recording sheets based on stapling position. That is, when loading the recording sheets, the control section 90 ensures that different bundles of the recording sheets will not overlap in the stapling position. More specifically, when the recording sheets is stapled at central 2 points, the control section 90 offsets the recording sheets in a direction perpendicular to the ejection direction of the recording sheets. In so doing, the control section 90 loads bundles of the recording sheets alternately or shifting each bundle little by little in one direction. This makes it possible to increase the maximum load capacity of the tray 8.

When two trays 8*a* and 8*b* are used, offsetting may be done for each of the trays 8*a* and 8*b*. Alternatively, offsetting may be done only when the recording sheets subjected to the first processing are ejected. In that case, offsetting is done in the same way as in the case of a single tray 8.

Incidentally, offsetting is not limited to this, and offsetting may be used to distinguish between recording sheets subjected to the first processing and recording sheets subjected to the second processing.

It goes without saying that the present technology is not limited to the above described embodiment and many changes and modifications may be made to the above described embodiment within the scope of the present technology. Also, although according to the present embodiment, recording sheets subjected to the first processing and recording sheets subjected to the second processing are loaded onto different trays, the two types of recording sheets may be loaded as a mixture thereof. For example, if 50 sets of recording sheets are subjected to the first processing and 3 sets of recording sheets are subjected to the second processing, recording sheets subjected to the first processing are loaded onto the upper tray while the remaining recording sheets subjected to the first processing and the recording sheets subjected to the second processing are loaded onto the lower tray.

Although the present embodiment has been described by taking as an example a post-processing apparatus provided with a single tray or two trays, the present technology is not limited this. The post-processing apparatus may be provided with three or more trays. In that case, the tray may be changed for each bundle of recording sheets. This eliminates the need for offsetting at the time of ejection and thereby simplifies control.

Although according to the present embodiment, when a desired number of recording sheets exceeds the maximum load capacity of the tray, the user is presented with new input conditions and allowed to select one of the presented input conditions, the present technology is not limited this. For example, the control section may select and automatically apply the input condition closest to the one entered by the user. In that case, the user needs to specify a selection criterion for the control section in advance.

Although according to the present embodiment, when a desired number of recording sheets exceeds the maximum load capacity of the tray, the control section creates new input conditions based on the input condition entered by the user, the present technology is not limited this. For example, as shown in FIG. 37, the user may specify a necessary number of sets to be stapled, via the operation section. This makes it possible to increase the number of sets that can be loaded onto the tray and staple the number of sets actually needed by the user, thereby avoiding unnecessary stapling processing.

Although according to the present embodiment, when a desired number of recording sheets exceeds the maximum load capacity of the tray, the control section creates new input conditions based on the input condition entered by the user and performs processing based on the input condition selected by the user from the new input conditions, the present technology is not limited this. For example, a list presented to the user may contain an item that specifies processing to be performed without changing the input condition, and when the user selects this item, the control section may output the input condition without change. Alternatively, when the user presses a Start button in the operation section without selecting any new input condition from the displayed list, the control section may output the input condition without change.

The invention claimed is:

1. A post-processing apparatus comprising:

an input section that receives an input condition;

a post-processing section that performs stapling processing;

a control section that controls the post-processing section based on the input condition; and a tray on which post-processed recording sheets are loaded, wherein the input condition includes mixed-processing information about first processing that involves stapling processing and second processing that does not involve stapling processing, wherein under certain input conditions, the control section loads recording sheets subjected to the first processing and recording sheets subjected to the second processing as a mixture thereof onto the tray in a single job, as requested, based on the input condition;

based on the input condition that includes the mixed-processing information, a maximum load capacity is set such that the recording sheets will not fall off the tray; and the control section calculates a load of the recording sheets based on the input condition including the mixed-processing information, judges whether or not the calculated load is greater than the maximum load capacity and changes a mixing ratio between the recording sheets subjected to the first processing and the recording sheets subjected to the second processing when the calculated load is greater than the maximum load.

2. The post-processing apparatus according to claim 1, wherein when changing the mixing ratio of the recording sheets, the control section creates input conditions that contain different pieces of mixed-processing information so that more recording sheets can be loaded onto the tray.

3. The post-processing apparatus according to claim 2, wherein the control section changes the mixing ratio of the recording sheets in such a way as to decrease a proportion of recording sheets to be subjected to the first processing and increase a proportion of recording sheets to be subjected to the second processing based on one piece of mixed-processing information.

4. The post-processing apparatus according to claim 3, further comprising:

a display section that displays input conditions; and wherein the input section allows a user command to be entered, and wherein the control section displays a list of changed input conditions in the display section and replaces the original input condition with an input condition selected from the list via the input section.

5. The post-processing apparatus according to claim 3, wherein:

the apparatus is capable of communicating with an outside terminal; and the control section presents a list of changed input conditions to the outside terminal from which the original input condition has been entered and replaces the original input condition with an input condition selected from the list by the outside terminal.

6. The post-processing apparatus according to claim 1, further comprising at least one additional tray on which post-processed recording sheets are loaded, and wherein the control section makes the post-processing section load the recording sheets subjected to the first processing and the recording sheets subjected to the second processing onto respective different trays.

7. The post-processing apparatus according to claim 1, wherein the control section makes the post-processing section load the recording sheets by offsetting the recording sheets to reduce bulk of staples and thereby load more recording sheets.

8. A post-processing apparatus comprising:

an input section that receives an input condition;

a post-processing section that performs stapling processing;

a control section that controls the post-processing section based on the input condition; and at least two trays on which post-processed recording sheets are loaded, wherein the input condition includes mixed-processing information about first processing that involves stapling processing and second processing that does not involve stapling processing, wherein under certain input conditions, the control section loads recording sheets subjected to the first processing and recording sheets subjected to the second processing as a mixture thereof onto the tray in a single job, as requested, based on the input condition that includes the mixed processing information, and wherein the control section sets a maximum load capacity such that recording sheets will not fall off the tray, and wherein when the control section causes recording sheets subjected to the first processing and recording sheets subjected to the second processing onto a single tray, the control section calculates a load of the recording sheets based on the input condition including the mixed processing information, judges whether the calculated load is greater than the maximum load capacity and changes a mixing ratio between the recording sheets subjected to the first processing and the recording sheets subjected to the second processing when the calculated load is greater than the maximum load, and wherein, under certain conditions, the control section makes the post-processing section load the recording sheets subjected to the first processing and the recording sheets subjected to the second processing onto respective different trays.

9. The post-processing apparatus according to claim 8, wherein when changing the mixing ratio of the recording sheets, the control section creates input conditions that contain different pieces of mixed-processing information so that more recording sheets can be loaded onto the tray.

10. The post-processing apparatus according to claim 9, wherein the control section changes the mixing ratio of the recording sheets in such a way as to decrease a proportion of recording sheets to be subjected to the first processing and increase a proportion of recording sheets to be subjected to the second processing based on one piece of mixed-processing information.

11. The post-processing apparatus according to claim 10, further comprising:

a display section that displays input conditions; and wherein the input section allows a user command to be entered, and wherein the control section displays a list of changed input conditions in the display section and replaces the original input condition with an input condition selected from the list via the input section.

12. The post-processing apparatus according to claim 10, wherein:

the apparatus is capable of communicating with an outside terminal; and the control section presents a list of changed input conditions to the outside terminal from which the original input condition has been entered and replaces the original input condition with an input condition selected from the list by the outside terminal.

13. The post-processing apparatus according to claim 8, wherein the control section makes the post-processing section load the recording sheets by offsetting the recording sheets to reduce bulk of staples and thereby load more recording sheets.

* * * * *